US006048369A

United States Patent [19]

Smith et al.

[11] Patent Number: 6,048,369

[45] Date of Patent: Apr. 11, 2000

[54] METHOD OF DYEING HYDROPHOBIC TEXTILE FIBERS WITH COLORANT MATERIALS IN SUPERCRITICAL FLUID CARBON DIOXIDE

[75] Inventors: Carl Brent Smith, Raleigh; Gerardo A. Montero, Garner; Walter A. Hendrix, Raleigh, all of N.C.

[73] Assignee: North Carolina State University, Releigh, N.C.

[21] Appl. No.: 09/162,817

[22] Filed: Sep. 29, 1998

Related U.S. Application Data

[63] Continuation-in-part of application No. 09/089,639, Jun. 3, 1998, abandoned.

[51] Int. Cl.[7] ..... D06P 1/00; D06P 5/00

[52] U.S. Cl. ..... 8/475; 8/922

[58] Field of Search ..... 8/475, 922

[56] References Cited

U.S. PATENT DOCUMENTS

| | | | |
|---|---|---|---|
| 3,987,138 | 10/1976 | Hege | 264/117 |
| 4,012,194 | 3/1977 | Maffei | 8/142 |
| 4,464,172 | 8/1984 | Lichtenstein | 604/65 |
| 4,478,720 | 10/1984 | Perrut | 210/659 |
| 4,502,488 | 3/1985 | Degironimo et al. | 128/692 |
| 4,806,171 | 2/1989 | Whitlocke et al. | 134/7 |
| 4,923,720 | 5/1990 | Lee et al. | 427/422 |
| 4,925,444 | 5/1990 | Orkin et al. | 604/80 |
| 4,943,403 | 7/1990 | Miyashita et al. | 264/233 |
| 5,027,742 | 7/1991 | Lee et al. | 118/330 |
| 5,105,843 | 4/1992 | Condron et al. | 137/13 |
| 5,169,433 | 12/1992 | Lindsey et al. | 71/118 |
| 5,171,613 | 12/1992 | Bok et al. | 427/422 |
| 5,198,197 | 3/1993 | Clay et al. | 422/256 |
| 5,199,956 | 4/1993 | Schlenker et al. | 8/473 |
| 5,203,843 | 4/1993 | Hoy et al. | 239/135 |
| 5,212,229 | 5/1993 | Taylor et al. | 524/556 |
| 5,233,021 | 8/1993 | Sikorski | 528/491 |
| 5,233,072 | 8/1993 | Kricsfalussy | 558/277 |
| 5,236,602 | 8/1993 | Jackson | 210/748 |

(List continued on next page.)

FOREIGN PATENT DOCUMENTS

| | | | |
|---|---|---|---|
| 47 45 98 | 3/1992 | European Pat. Off. | D06P 3/54 |
| 47 45 99 | 3/1992 | European Pat. Off. | D06P 3/54 |
| 47 46 00 | 3/1992 | European Pat. Off. | D06P 3/54 |
| 54 13 37 | 11/1992 | European Pat. Off. | D06P 3/54 |
| 39 04 513 | 8/1990 | Germany | A61L 2/16 |

(List continued on next page.)

OTHER PUBLICATIONS

Archwal, "Dyeing in Supercritical Carbon Dioxide: Quantum Jump from Ecological Point of View", *Colourage,* Dec. 1993, pp. 23–25.

Atkins, *Physical Chemistry* fifth edition, 1994, New York: W.H Freeman and Company, pp. 43–44.

(List continued on next page.)

*Primary Examiner*—Margaret Einsmann

*Attorney, Agent, or Firm*—Jenkins & Wilson, P.A.

[57] ABSTRACT

Processes for dyeing a hydrophobic textile fiber with a colorant material using a SCF—$CO_2$ dyebath are described. One process employs cooling, without venting or removing $CO_2$ from the system, to a target $CO_2$ temperature at or below the glass transition temperature of the hydrophobic fiber, followed by the venting of the dyeing system to atmospheric pressure. The other process employs venting, without cooling, to a target $CO_2$ density where dye is no longer soluble in the SCF—$CO_2$, followed by cooling to a target temperature and then venting to atmospheric pressure. Optionally, the temperature of the dyeing process is established by heating the process according to a selected temperature profile.

49 Claims, 7 Drawing Sheets

U.S. PATENT DOCUMENTS

| | | | |
|---|---|---|---|
| 5,267,455 | 12/1993 | Dewees et al. | 68/5 |
| 5,268,102 | 12/1993 | Clay et al. | 210/634 |
| 5,269,815 | 12/1993 | Schlenker et al. | 8/475 |
| 5,279,615 | 1/1994 | Mitchell et al. | 8/142 |
| 5,298,032 | 3/1994 | Schlenker et al. | 8/475 |
| 5,306,350 | 4/1994 | Hoy et al. | 134/22.14 |
| 5,316,591 | 5/1994 | Chao et al. | 134/34 |
| 5,370,742 | 12/1994 | Mitchell et al. | 134/10 |
| 5,374,305 | 12/1994 | Glancey et al. | 106/287.23 |
| 5,412,958 | 5/1995 | Iliff et al. | 68/5 |
| 5,417,768 | 5/1995 | Smith, Jr. et al. | 134/10 |
| 5,431,843 | 7/1995 | Mitchell et al. | 252/186.38 |
| 5,443,796 | 8/1995 | Coeling et al. | 422/129 |
| 5,456,759 | 10/1995 | Stanford, Jr. et al. | 134/1 |
| 5,467,492 | 11/1995 | Chao et al. | 8/159 |
| 5,474,812 | 12/1995 | Truckenmüller et al. | 427/430.1 |
| 5,486,212 | 1/1996 | Mitchell et al. | 142/8 |
| 5,496,901 | 3/1996 | DeSimone | 526/89 |
| 5,509,431 | 4/1996 | Smith, Jr. et al. | 134/95.1 |
| 5,509,959 | 4/1996 | Nielson et al. | 106/287.35 |
| 5,512,058 | 4/1996 | Gavend et al. | 8/94.18 |
| 5,512,231 | 4/1996 | Thies et al. | 264/169 |
| 5,520,078 | 5/1996 | Saus et al. | 8/475 |
| 5,526,834 | 6/1996 | Mielnik et al. | 134/105 |
| 5,578,088 | 11/1996 | Schrell et al. | 8/475 |
| 5,601,707 | 2/1997 | Clay et al. | 210/198.2 |
| 5,613,509 | 3/1997 | Kolb et al. | 134/56 |
| 5,618,894 | 4/1997 | DeSimone et al. | 526/89 |
| 5,651,276 | 7/1997 | Purer et al. | 68/5 |
| 5,669,251 | 9/1997 | Townsend et al. | 68/58 |
| 5,938,794 | 8/1999 | Eggers et al. . | |

FOREIGN PATENT DOCUMENTS

| | | | |
|---|---|---|---|
| 39 06 724 | 9/1990 | Germany | D06P 1/00 |
| 39 06 735 | 9/1990 | Germany | D06L 3/00 |
| 43 32 219 | 3/1994 | Germany | D06P 1/16 |
| 44 29 470 | 3/1995 | Germany | D06P 5/04 |
| 43 33 221 | 4/1995 | Germany | C08J 7/00 |
| 43 36 941 | 5/1995 | Germany | D06L 1/00 |
| 43 044 021 | 6/1995 | Germany | D06P 1/16 |
| 44 08 784 | 9/1995 | Germany | B08B 3/08 |
| 8104830 | 4/1996 | Japan | C09D 5/03 |
| 8113652 | 5/1996 | Japan | C08J 3/12 |
| 883208 | 11/1981 | U.S.S.R. | D06B 1/02 |
| 93/14259 | 7/1993 | WIPO | D06M 11/76 |
| 94/09201 | 4/1994 | WIPO | D06B 5/12 |
| 95/01221 | 1/1995 | WIPO | B01J 2/04 |
| 96/00610 | 1/1996 | WIPO | B01J 2/04 |
| 97/13915 | 4/1997 | WIPO | D06P 1/00 |
| 97/14838 | 4/1997 | WIPO | D06B 5/12 |
| 97/14843 | 4/1997 | WIPO | D06P 1/00 |
| 97/33033 | 9/1997 | WIPO | D06L 1/00 |

OTHER PUBLICATIONS

Bartle et al., "Solubilities of Solids and Liquids of Low Volatility in Supercritical Carbon Dioxide", *J. Phys. Chem. Ref. Data,* vol. 20, No. 4, 1991, pp. 713–756.

Burk et al., "Solubilities of Solids in Supercritical Fluids", *The Canadian Journal of Chemical Engineering,* vol. 70, apr. 1992, pp. 403–407.

Dobbs et al., "Modification of Supercritical Fluid Phase Behavior using Polar Cosolvents", *Ind. Eng. Chem. Res.,* vol. 26, 1987a, pp. 56–65.

Dobbs et al., "Selectivities in Pure and Mixed Supercritical Fluid Solvents", *Ind. Eng. Chem. Res.,* vol. 26, 1987b, pp. 1476–1482.

Drews et al., "An Investigation of the Effects of Temperature and Pressure Ramping on Shade in the Stock Dyeing of PET with Supercritical $CO_2$, Part I: Dyeing at Costant T&P", *AATCC Book of Papers,* 1996, pp. 360–368.

Gupta et al., "Solvent Effect on Hydrogen Bonding in Supercritical Fluids", *J. Phys. Chem.* vol. 97, 1993, pp. 707–715.

Haarhaus et al., "Hugh–Pressure Investigations on the Solubility of Dispersion Dyestuffs in Supercritical Gases by VIS/NIR–Spectroscopy. Part I–1, 4–Bis–(octadecylamino)–9, 10–anthraquinone and Disperse Orange in $CO_2$ and $N_2O$ up to 180 MPa", *The Journal of Supercritical Fluids,* vol. 8, 1995, pp. 100–106.

Holme, "Latest Developments in Dyes and Finishes for Man–Made Fibres", *International Dryer,* Oct. 1993, pp. 13–17.

Knittel et al., "Application of Supercritical Carbon Dioxide in Finishing Processes", *J. Text. Inst.,* vol. 84, No. 4, 1993, pp. 534–552.

Kramrisch, "Dyeing Technical Fibres in Supercritical Carbon Dioxide", *International Dryer,* Aug. 1992, p. 12.

Montero et al., "Supercritical Fluid Extraction of Contaminated Soil", *J. Environ. Sci. Health,* A32(2) 1997, pp. 481–495.

Phelps et al., "Past, Present, and Possible Future Applications of Supercritical Fluid Extraction Technology", *Journal of Chemical Education,* vol. 73, No. 12, Dec. 1996, pp.1163–1168.

Saus et al., "Dyeing with Supercritical Carbon Dioxide—An Alternative to High Temperature Dyeing of Polyester", *Textil–praxis International* (*Foreign Edition*), Nov. 1992, pp. 1052–1054.

Saus et al., "Dyeing with Supercritical Carbon Dioxide–Physico–Chemical Fundamentals", *Textil–praxis International* (*Foreign Edition*), Jan. 1993a, pp. 32–36.

Saus et al., "Dyeing of Textiles in Supercritical Carbon Dioxide", *Textile Res. J.,* vol. 63, 1993b, pp. 135–142.

Saus et al., "Water–Free Dyeing of Synthetic Material–Dyeing in Supercritical $CO_2$", *International Textile Bulletin, Dyeing/Printing/Finishing,* 1st Quarter 1993, pp. 20–22.

Scheibli et al., "Dyeing in Supercritical Carbon Dioxide—An Environmental Quantum Leap in Textile Processing", *Chemiefasern/Textilindustrie,* vol. 43/95, May 1994, pp. E64–E65.

Skoog et al., *Principles of Instrumental Analysis,* 1992, Forth Worth: Saunders College Publishing, pp. 124–126.

Swidersky et al., "High–Pressure Investigations on the Solubility of Anthraquinone Dyestuffs in Sypercritical Gases by VIS–Spectroscopy. Part II–1,4–Bis–(n–alkylamino)–9, 10–anthraquinones and Disperse Red II in $CO_2$, $N_2O$, $CHF_3$ up to 180 MPa", *The Journal of Supercritical Fluids,* vol. 9, 1996, pp. 12–18.

Tavana et al., "Scanning of Cosolvents for Supercritical Fluids Solubilizatio of Organics", *AIChE Journal*, vol. 35, No. 4, Apr. 1989, pp. 645–648.

Poulakis et al. "Dyeing of Polyester in Supercritical $Co_2$", *Chemie Fasern/Textilindustrie,* vol. 41–93, Feb. 1991, pp. 142–147.

U.S. Environmental Protection Agency, "Best Management Practices for Pollution Prevention in the Textile Industry," p. 21–22, Sep. 1996.

METHOD OF DYEING HYDROPHOBIC TEXTILE FIBERS WITH COLORANT MATERIALS IN SUPERCRITICAL FLUID CARBON DIOXIDE

CROSS REFERENCE TO RELATED APPLICATIONS

This application is a continuation-in-part of co-pending U.S. patent application Ser. No. 09/089,639, filed Jun. 3, 1998 now abandoned, the entire contents of which herein incorporated by reference.

TECHNICAL FIELD

The present invention relates generally to textile dyeing and more particularly to the dyeing of hydrophobic textile fibers in supercritical fluid carbon dioxide (SCF—$CO_2$).

BACKGROUND ART

It will be appreciated by those having ordinary skill in the art that conventional aqueous dyeing processes for textile materials, particularly hydrophobic textile fibers, generally provide for effective dyeing, but possess many economic and environmental drawbacks. Particularly, aqueous dyebaths which include organic dyes and dyeing assistants must be disposed of according to arduous environmental standards. Additionally, heat must be applied to dry the textile material after dyeing in an aqueous bath. Compliance with environmental regulations and process heating requirements thus increase the costs of aqueous textile dyeing to both industry and the consuming public alike. Accordingly, there is a long-felt need in the art for an alternative dyeing process wherein such problems are avoided.

One alternative to aqueous dyeing that has been proposed in the art is the dyeing of textile materials, including hydrophobictextile fibers like polyester, in a supercritical fluid. Particularly, textile dyeing methods using SCF—$CO_2$ have been explored.

However, those in the art who have attempted to dye textile materials, including hydrophobic textile fibers, in SCF—$CO_2$ have encountered a variety of problems. These problems include, but are not limited to, "crocking" (i.e. tendency of the dye to rub off when the dyed article is touched) of the dyed textile article; unwanted deposition of the dye onto the article and/or onto the dyeing apparatus during process termination; difficulty in characterizing solubility of the dyes in SCF—$CO_2$; difficulty introducing the dyes into the SCF—$CO_2$ flow; and difficulty in preparing the dyes for introduction into the dyeing process. These problems are exacerbated when attempts to extrapolate from a laboratory dyeing process to a commercial scale process are made.

There have been several attempts in the prior art to address the problems associated with dyeing of textile materials, particularly hydrophobic textile fibers, in SCF—$CO_2$. One such attempt is described in Patent Publication No. WO 97/13915 published Apr. 17, 1997, inventors Eggers et al., assignee Amann and Söhne GMBH & Co. This publication describes a process for dyeing a textile substrate, particularly polyester yarns, using SCF—$CO_2$. The process includes a pressure and/or temperature decrease and/or volume enlargement as part of the termination of the process. The described process attempts to provide a dyed textile substrate having a high color-fastness level. However, this goal is pursued by removal of dye material from the fluid so that in the final stage of the process a fluid largely free from residual dye flows against or through the dyed textile substrate. Thus, complex additional systems, such as a secondary circulation system, are required to provide dye-free fluid to the process.

Moreover, dye-free fluid can be supplied to the autoclave or first circulation system associated with the autoclave before or during execution of the pressure decrease, temperature decrease, and/or volume enlargement. Thus, there is a lack of criticality associated with the timing of the incorporation of the dye-free fluid into the system, as well as a lack of criticality associated with whether a pressure decrease, temperature decrease, and/or volume enlargement is selected for process termination. Finally, the spent sorbent material requires disposal after process termination, which can create environmental concerns analogous to those encountered with the use of conventional aqueous dyeing processes.

Poulakis et al., *Chemiefasern/Textilindustrie*, Vol. 43–93, February 1991, pages 142–147 discusses the phase dynamics of SCF—$CO_2$. An experimental section describing an apparatus and method for dyeing polyester in SCF—$CO_2$ in a laboratory setting is also presented. This method is thus believed to be limited in practical application.

U.S. Pat. No. 5,199,956 issued to Schlenker et al. on Apr. 6, 1993 describes a process for dyeing hydrophobic textile materials with disperse dyes by heating the disperse dyes and textile material in SCF—$CO_2$ with azo dyes having a variety of chemical structures. The patent thus attempts to provide an improved SCF—$CO_2$ dyeing process by providing a variety of dyes for use in such a process.

U.S. Pat. No. 5,250,078 issued to Saus et al. on Oct. 5, 1993 describes a process for dyeing hydrophobic textile materials with disperse dyes by heating the disperse dyes and textile material in SCF—$CO_2$ under a pressure of 73 to 400 bar at a temperature in the range from 80° C. to 300° C. Then the pressure and temperature are lowered to below the critical pressure and the critical temperature, wherein the pressure reduction is carried out in a plurality of steps.

U.S. Pat. No. 5,578,088 issued to Schrell et al. on Nov. 26, 1996 describes a process for dyeing cellulose fibers or a mixture of cellulose and polyester fibers, wherein the fiber material is first modified by reacting the fibers with one or more compounds containing amino groups, with a fiber-reactive disperse dyestuff in SCF—$CO_2$at a temperature of 70–210° C. and a $CO_2$ pressure of 30–400 bar. Specific examples of the compounds containing amino groups are also disclosed. Thus, this patent attempts to provide level and deep dyeings having very good fastness properties by chemically altering the fibers prior to dyeing in SCF—$CO_2$.

U.S. Pat. No. 5,298,032 issued to Schlenker et al. on Mar. 29, 1994 describes a process for dyeing cellulosic textile material with disperse dyes, wherein the textile material is pretreated with an auxiliary that promotes dye uptake subsequent to dyeing under pressure and at a temperature of at least 90° C., with a disperse dye from SCF—$CO_2$. The auxiliary is described as being preferably polyethylene glycol. Thus, this patent attempts to provide improved SCF—$CO_2$ dyeing by pretreating the material to be dyed.

What is needed, then, is an improved method of dyeing hydrophobic textile fibers with colorant materials in SCF—$CO_2$ which addresses the problems identified, yet heretofore unsolved, by the art. An improved method of dyeing hydrophobic textile fibers with colorant materials in SCF—$CO_2$ which resolves the "crocking" problem identified in the art is particularly desired.

DISCLOSURE OF THE INVENTION

A process for dyeing a hydrophobic textile fiber with a colorant material, such as a disperse dye, using a SCF—$CO_2$ dyebath is described. The process comprises the steps of selecting a colorant material that is soluble in SCF—$CO_2$ at a first temperature range and sparingly soluble in SCF—$CO_2$ or near-critical fluid $CO_2$ at a second temperature range, wherein the first temperature range is higher than the second temperature range; heating the hydrophobic textile fiber and the colorant material in SCF—$CO_2$ under SCF pressure conditions to a temperature within the first temperature range to initiate dyeing; continuing the dyeing of the hydrophobic textile fiber by cooling the process to a temperature within the second temperature range without venting the SCF—$CO_2$, whereby SCF—$CO_2$ density remains constant; and terminating the process after a predetermined dyeing time.

Optionally, the process may comprise the steps of selecting a colorant material that is soluble in SCF—$CO_2$ at a first density range and sparingly soluble in SCF—$CO_2$ or near-critical fluid $CO_2$ at a second density range, the second density range comprising a lower density range that the first density range; heating the hydrophobic textile fiber and the colorant material in SCF—$CO_2$ under SCF pressure conditions to a predetermined dyeing temperature; adjusting the density of the SCF—$CO_2$ under SCF pressure conditions to a density within the first density range by adding $CO_2$ to initiate dyeing of the hydrophobic textile fiber with the colorant material; continuing the dyeing of the hydrophobic textile fiber by reducing the density of the SCF—$CO_2$ to a density within the second density range by venting $CO_2$ from the process without reducing the temperature of the process; and terminating the process after a predetermined dyeing time.

Accordingly, it is an object of the present invention to provide an improved process for dyeing a hydrophobic textile fiber with a colorant material using a SCF—$CO_2$ dyebath.

It is another object of the present invention to provide an improved process for dyeing a hydrophobic textile fiber with a colorant material using a SCF—$CO_2$ dyebath wherein the dyed fiber resists crocking.

It is another object of the present invention to provide an improved process for dyeing a hydrophobic textile fiber with a colorant material using a SCF—$CO_2$ dyebath that is particularly suited for batch dyeing in a commercial setting.

Some of the objects of the invention having been stated above, other objects will become evident as the description proceeds, when taken in connection with the accompanying drawings as best described hereinbelow.

DETAILED DESCRIPTION OF THE INVENTION

Processes for dyeing a hydrophobic textile fiber with a colorant material using a SCF—$CO_2$ dyebath are employed in accordance with the present invention to avoid crocking. One process employs cooling, without venting or removing $CO_2$ from the system, to a target $CO_2$ temperature at or below the glass transition temperature of the hydrophobic fiber, followed by the venting of the dyeing system to atmospheric pressure. The other process employs venting, without cooling, to a target $CO_2$ density where dye is no longer soluble in the SCF—$CO_2$, followed by cooling to a target temperature and then venting to atmospheric pressure.

The process chosen depends on the solubility and affinity characteristics of the dye being used. The first process as described above is one of temperature reduction at constant density, while the second process as described above is one of density reduction at constant temperature. Thus, in accordance with the present invention, venting and not venting $CO_2$ are density control steps which are used in the prevention of crocking. Alternatively, density reduction can also be achieved by expansion, that is, opening the system to additional volumes such as another vessel or more flow loop.

Figure 5:
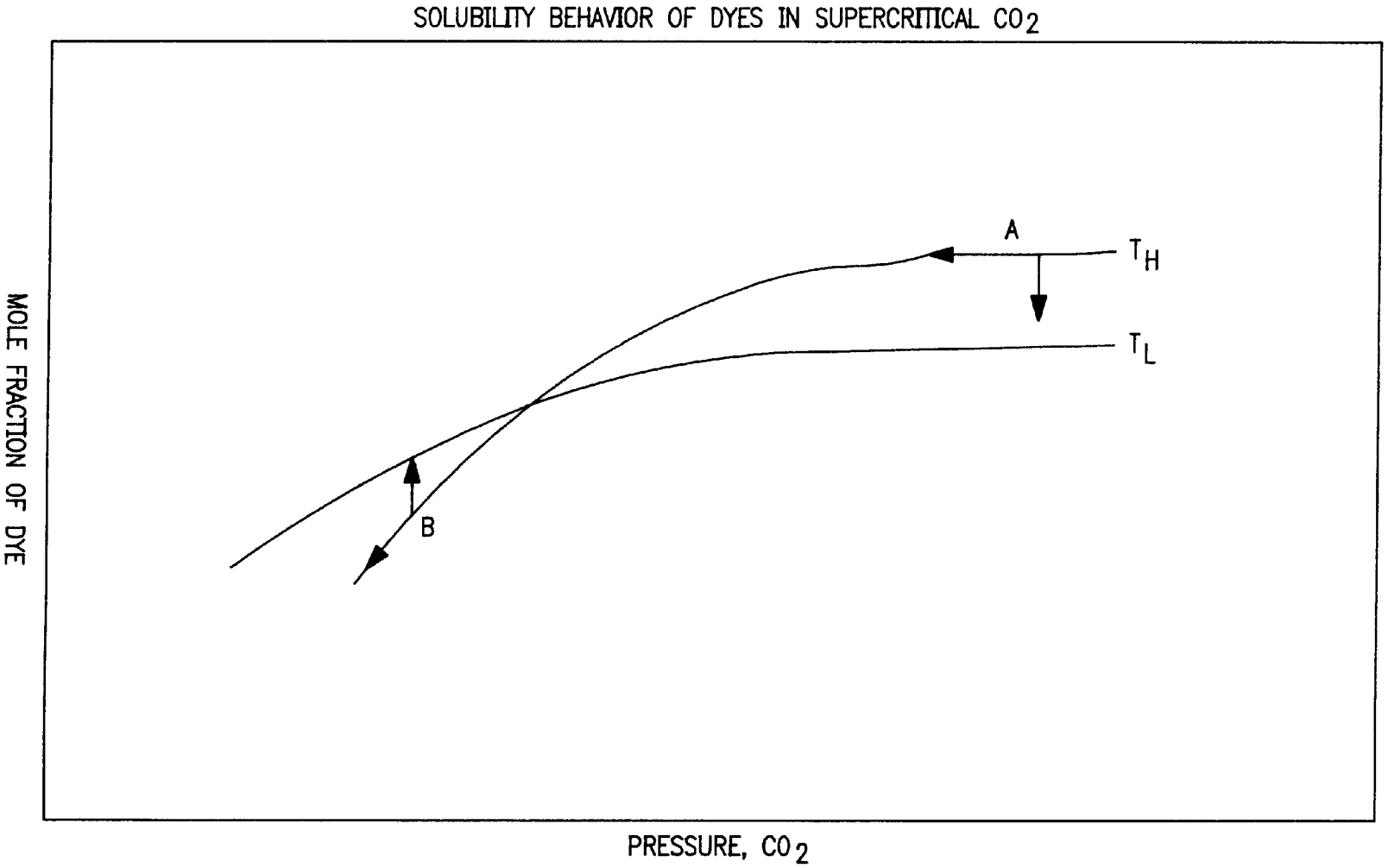
FIG. 5 is a graph which shows qualitatively the dependence of dye solubility on SCF—$CO_2$ density and temperature.

Thus, it is contemplated that a step in a dyeing process in accordance with the present invention that prevents crocking may be referred to as a depressurization step. This step occurs after the dyeing step and employs a path of either (1) cooling, without venting or expanding, to a target $CO_2$ temperature followed by venting to atmospheric pressure; or (2) venting or expanding, without cooling, to a target $CO_2$ density followed by complete venting to atmospheric pressure. The depressurization step is controlled via either process temperature or pressure. Pressure is regulated through venting or not venting $CO_2$. Density changes via venting $CO_2$ can thus be plotted as pressure changes as shown in FIG. 5 and as described in McHugh et al., *Supercritical Fluid Extraction*, 2d ed. Butterworth-Heinemann, Boston, Mass. (1994) with respect to the behavior of naphthalene as a solute in a supercritical solvent (ethylene).

By way of further explanation, the depressurization steps used in accordance with the present invention for temperature-controllable and density-controllable colorant material, one must consider the solubility behavior of the colorant materials (e.g. dyes) in SCF—$CO_2$. FIG. 5 shows qualitatively the dependence of dye solubility on SCF—$CO_2$ density and temperature. In FIG. 5, $T_H$ refers to the higher temperature and $T_L$ the lower temperature as discussed below in the Examples. Note that at some density the solubility curves for these two temperatures will cross each other. This temperature dependence is observed for dyes in SCF—$CO_2$ as described herein, and indeed, for all solutes in supercritical fluids. Examples of this behavior for naphthalene in supercritical ethylene and benzoic acid in SCF—$CO_2$ are described in McHugh et al., *Supercritical Fluid Extraction*, 2d Ed., Butterworth-Heinemann, Boston, Mass. (1994), herein incorporated by reference.

The relative position of the crossover on the solubility plot and the actual usage level of the dye in a practical dyeing process varies, so that one dye may be used near point A, well above the crossover, and another dye may be used near point B, well below the crossover. The actual point on its solubility plot where any particular dye is used depends on its properties, such as molecular weight, heat of sublimation, melting point, and the like. Such information may be found in the Color Index.

If one is at point A on the curve for $T_H$ where the slope of solubility as a function of SCF—$CO_2$ density is approximately zero, a decrease in SCF—$CO_2$ density at constant temperature (i.e., in the direction of the left-pointing arrow) gives little or no decrease in the solubility of the dye. On the other hand, decrease in SCF—$CO_2$ temperature (i.e., in the direction of the downward pointing arrow) results in decreased dye solubility. Temperature-controllable dyes are those for which the dyeing conditions (temperature, density of $CO_2$-x-axis, and mole fraction of dye-y-axis) correspond to a relative point such as point A on the dye solubility plot. CI Disperse Blue 77 is an example of such a dye. For dyes of this type, controlled reduction in temperature will result in controlled reduction of dye solubility, which causes the dye to partition favorably towards the textile fiber that is being dyed. It is noted that the temperature preferably remains above $T_g$, the fiber dyeing temperature, at all times. As the dye exhausts out of solution, it is sorbed into the fiber because the conditions are favorable to dye uptake.

Conversely, lowering density (e.g., by venting) at constant temperature will not result in significant reduction in solubility for a temperature-controlled dye until a point on the solubility curve is reached where the solubility versus density slope is positive. At this point the dye solubility drops rapidly with SCF—$CO_2$ density reduction. Dye exhausts from the solution often at a rate that is greater than the rate that it can be taken up by the fiber. The dye may thus precipitate and crocking occurs.

If dye is used at a relative point B on the curve for $T_H$ where the slope is positive and the $T_L$ curve lies above the $T_H$ curve, a decrease in SCF—$CO_2$ temperature (i.e., in the direction of the upward pointing arrow) may result in an increase in dye solubility. Therefore, an associated "stripping" effect may occur whereby dye actually desorbs from the fiber into the solution. By contrast, decrease in SCF—$CO_2$ density at constant temperature (i.e., in the direction of the arrow that follows the $T_H$ curve) results in decrease in dye solubility. Density-controllable dyes are those for which the dyeing conditions correspond to a relative point such as point B on the dye solubility plot. Numerous dyes have been observed to exhibit this behavior; e.g., CI Disperse Red 167, CI Disperse Yellow 86, CI Disperse Blue 60, and CI Disperse Violet 91 (See Table 2). For dyes of this type, controlled reduction in density at constant temperature will result in controlled reduction in dye solubility, which causes the dye to partition favorably towards the textile fiber that is being dyed. As the dye exhausts out of solution, it is sorbed into the fiber because the conditions are favorable to dye uptake; i.e., $T>T_9$.

On the other hand, lowering the temperature at constant density will result in significant increase in solubility for a density-controllable dye. If a path is followed where the dye bath is cooled then vented, crocking may occur because the dyeing rate will be too low as the dye exhausts out of solution, and thus, the dye will precipitate rather than be sorbed into the fiber.

Thus, the process whereby a dye partitions from the solution towards the fiber is complex, depending not only on its solubility in SCF—$CO_2$, but also on its affinity for the fiber, the fiber diffusion coefficient and time at each particular set of conditions; i.e., SCF—$CO_2$ temperature and density. Therefore, it is further suggested that there are depressurization paths, other then the ones described above for points A and B, whereby crocking may be avoided. For example, from points A and B, paths are followed where both cooling and density reduction (venting) simultaneously are employed. Such paths may have certain advantages, such as from the standpoint of reducing process time, as compared to the depressurization paths described above for temperature-controllable and density-controllable dyes. However, the processes described above and in Examples 1 and 2 produce high quality and improved dyeings of hydrophobic textile materials in SCF—$CO_2$ as compared to prior art processes and thus are believed to represent a significant advance in the art.

While the following terms are believed to have well defined meanings in the art, the following definitions are set forth to facilitate explanation of the invention.

The terms "supercritical fluid carbon dioxide" or "SCF—$CO_2$" mean $CO_2$ under conditions of pressure and temperature which are above the critical pressure ($P_c$=about 73 atm) and temperature ($T_c$=about 31° C.). In this state the $CO_2$ has approximately the viscosity of the corresponding gas and a density which is intermediate between the density of the liquid and gas states.

The term "hydrophobic textile fiber" is meant to refer to any textile fiber comprising a hydrophobic material. More particularly, it is meant to refer to hydrophobic polymers which are suitable for use in textile materials such as yarns, fibers, fabrics, or other textile material as would be appreciated by one having ordinary skill in the art. Preferred examples of hydrophobic polymers include linear aromatic polyesters made from terephathalic acid and glycols; from polycarbonates; and/or from fibers based on polyvinyl chloride, polypropylene or polyamide. A most preferred example comprises one hundred fifty denier/34 filament type 56 trilobal texturized yarn (polyester fibers) such as that sold under the registered trademark DACRON® (E.I. Du Pont De Nemours and Co.). Glass transition temperatures of preferred hydrophobic polymers, such as the listed polyesters, typically fall over a range of about 55° C. to about 65° C. in SCF—$CO_2$.

The term "colorant material" is meant to refer to sparingly water-soluble or substantially water-insoluble dyes. Examples include, but are not limited to, forms of matter identified in the Colour Index, an art-recognized reference manual, as disperse dyes. Additional examples are found Tables 1 through 3, as set forth hereinbelow. Preferably, the colorant material comprises press-cake solid particles which has no additives.

The term "sparingly soluble", when used in referring to a dye, means that the dye is not readily dissolved in a particular solvent at the temperature and pressure of the solvent. Thus, the dye tends to fail to dissolve in the solvent, or alternatively, to precipitate from the solvent, when the dye is "sparingly soluble" in the solvent at a particular temperature, density and/or pressure.

The term "crocking", when used to describe a dyed article, means that the dye exhibits a transfer from dyed material to other surfaces when rubbed or contacted by the other surfaces.

The term "fiber diffusion coefficient" is meant to refer to the flux of dye into a fiber and is analogous to a heat transfer coefficient.

Following long-standing patent law convention, the terms "a" and "an" mean "one or more" when used in this application, including the claims.

The following Examples have been included to illustrate preferred modes of the invention. Certain aspects of the following Examples are described in terms of techniques and procedures found or contemplated by the present inventors to work well in the practice of the invention. These Examples are exemplified through the use of standard laboratory practices of the inventors. In light of the present disclosure and the general level of skill in the art, those of skill will appreciate that the following Examples are intended to be exemplary only and that numerous changes, modifications and alterations can be employed without departing from the spirit and scope of the invention.

EXAMPLE 1

Temperature Controllable Dyes

As disclosed in this Example, the novel dyeing process includes, first of all, the selection of a colorant material which is soluble in SCF—$CO_2$ at a high temperature, and which is sparingly soluble in SCF—$CO_2$ or near-critical fluid $CO_2$ at a lower temperature. A preferred high temperature range comprises about 60° C. to about 200° C. A more preferred high temperature range comprises about 90° C. to about 140° C. A most preferred high temperature range comprises about 100° C. to about 130° C. Indeed, as described in Tables 1A through 1C below, the average high temperature is about 100° C. As will be observed in the Tables below, the high temperature is also referred to herein as the "dyeing temperature" or "$T_{dyeing}$" in that dyeing is initiated by heating the process to the high temperature and that dyeing continues for a predetermined time at this temperature. It should also be noted that the high temperature is preferably lower than the melting/degradation temperature of the dye itself, and is preferably lower than the melting temperature of the hydrophobic textile fiber, e.g. 252° C. for polyester.

The preferred lower temperature range comprises about 30° C. to about 80° C. Indeed, it is preferred that the lower temperature range falls within temperatures that maintain the SCF—$CO_2$ in a SCF state and that the lower temperature range falls above the glass transition temperatures of the textile material being dyed. Thus, a more preferred range for the lower temperature range comprises about 70° C. to about 75° C.

The pressure of the process is preferably at least high enough that the $CO_2$ is in the SCF state. Exemplary pressure ranges include from about 73 atm to about 400 atm. Preferred process parameters are set forth in the Tables 1A, 1B and 1C which follow.

Abbreviations used in Tables 1A, 1B and 1C atm—Atmosphere.

$\rho_{package}$—Density of hydrophobic textile fiber package to be dyed in grams per cubic centimeter (g/cm$^3$).

$\rho co_2$—Density of $CO_2$ in grams per cubic centimeter (g/cm$^3$).

I/O—Inside-to-outside circuit.

New—Taper of hydrophobic textile fiber package=40%

O/I—Outside-to-inside circuit.

Old—Taper of hydrophobic textile fiber package 100%

$Package_{wt}$—Weight of hydrophobic textile fiber package in grams (g).

psi—Pounds per square inch.

$Qco_2$—Flow rate of $CO_2$ in gallons per minute (gpm).

(R)—Reverse $CO_2$ flows in the expansion vessel.

res.—Residue.

$T_{dyeing}$(° C.)—Temperature in higher temperature range at which dyeing is initiated.

t—Time elapsed during dyeing process.

*—Fill with $CO_2$ at T=50° C.

+—High density packages.

TABLE 1A

AVERAGE EXPERIMENTAL CONDITIONS AND PACKAGES CHARACTERISTICS

Disperse dye Blue 77

| Run | Pressure (atm/psi) | $T_{dyeing}$ (° C.) | $\rho co_2$ (g/cm$^3$) | $Qco_2$ (gpm) | $\rho_{package}$ (g/cm$^3$) | $Package_{wt.}$ (g) | Dye holder device |
|---|---|---|---|---|---|---|---|
| 001 | 306/4500 | 130–135 | 0.5297 | 4.87:I/O(t = 80 min) | 0.3990 | 515 | One fiber bag |
| 002A | 310/4550 | 110–115 | 0.6225 | 5.02:I/O(t = 80 min) | 0.3562 | 475 | Screen cone |
| 002B | 308/4525 | 125–130 | 0.5763 | 1.21/4.11(t = 80 min) | 0.3562 | 475 | Bottom filter |
| 003(R) | 316/4650 | 105–110 | 0.6332 | 2.91/5.66(t = 120 min) | 0.3504 | 460 | 2 flat screens |
| 004 | 313/4600 | 100–115 | 0.6118 | 3.30:I/O(t = 60 min) | 0.3555 | 475 | Dosage-pump |
| 005 | 320/4700 | 110–115 | 0.6373 | 3.09:I/O(t = 60 min) | 0.3763 | 515 | Dosage-pump |
| 006(R) | 305/4475 | 110–115 | 0.6180 | 2.75:I/O(t = 90 min) | 0.3941 | 515 | Fluidized bed |
| 007(R) | 283/4163 | 115–125 | 0.6245 | 0.62/3.66(t = 180 min) | 0.3885 | 515 | Fluidized bed |
| 008(R) | 270/3970 | 60–110 | 0.692 | 4.78{1[30(I) × 2(O)]} | 0.4051 | 520 | Fluidized bed |
| 009 | 292/4289 | 105–110 | 0.6439 | 3.20:I/O(t = 300 min) | 0.3950 | 390 | Flat plate |
| 010* | 287/4220 | 92–100 | 0.6311 | 3.31:I/O(t = 120 min) | 0.4190 | 429 | Flat plate |
| 011* | 299/4400 | 94–100 | 0.6511 | 4.75{6[6(I) × 2(O)]} | 0.4780 | 445 | Flat plate |
| 012 | 320/4706 | 97–98.1 | 0.6640 | 4.40{6[6(I) × 3(O)]} | 0.501 | 470 | Cone-plate |
| 013 | 313/4598 | 98.3–101 | 0.6936 | 0.84{8[6(I) × 2(O)]} | 0.595+ | 560 | Fluidized bed |
| 014 | 297/4363 | 92.4–118 | 0.6308 | 5.01{12[6(I) × 2(O)]} | 0.610 | 575 | Cone-plate |
| 015 | 296/4355 | 105–110 | 0.6399 | 3.22{3[6(I) × 2(O)]} | 0.604 | 565 | Cone-plate |

TABLE 1B

AVERAGE EXPERIMENTAL CONDITIONS AND PACKAGES CHARACTERISTICS

Disperse dye Red 167

| Run | Pressure (atm/psi) | $T_{dyeing}$ (° C.) | $\rho co_2$ (g/cm$^3$) | $Qco_2$ (gpm) | $\rho_{package}$ (g/cm$^3$) | $Package_{wt.}$ (g) | Dye holder device |
|---|---|---|---|---|---|---|---|
| 016 | 309/4539 | 125–130 | 0.5939 | 2.87{3[6(I) × 2(O)]} | 0.604 | 565 | Plate/Filter |
| 017 | 316/4645 | 125–130 | 0.5858 | 4.56{4[6(I) × 2(O)]} | 0.570 | 535 | Plate/Filter |
| 018A/B | 2572/3376 | 105–110 | 0.43/0.51 | 4.20{4[6(I) × 2(O)]} | 0.511 | 480 | Plate/Filter |
| 019 | 212/3120 | 100 | 0.49 | 4.21{4[6(I) × 3(O)]} | 0.560 | 525 | Plate/Filter |
| 020 | 245/3594 | 100–110 | 0.53–0.54 | 5.10{6[6(I) × 2(O)]} | 0.590 | 555 | Plate/Filter |
| 021 | 226/3325 | 100 | 0.5111 | 5.26{6[6(I) × 2(O)]} | 0.588 | 550 | Plate/Filter |

TABLE 1C

AVERAGE EXPERIMENTAL CONDITIONS AND PACKAGES CHARACTERISTICS

Disperse dye Violet 91

| Run | Pressure (atm/psi) | $T_{dyeing}$ (° C.) | $\rho co_2$ (g/cm$^3$) | $Qco_2$ (gpm) | $\rho_{package}$ (g/cm$^3$) | $Package_{wt.}$ (g) | Remarks |
|---|---|---|---|---|---|---|---|
| DV-2 | 317/4665 | 100–102 | 0.6430 | 7.24:I/O (t = 16 min) | 0.592 | 540 (old) | Small dye res. |
| DV-3 | 313/4595 | 100–101 | 0.6395 | 6.71:I/O (t = 16 min) | 0.649 | 570 (new) | Small dye res. |
| DV-4 | 292/4293 | 90–92 | 0.6599 | 6.51:I/O (t = 16 min) | 0.660 | 500 (new) | Dye residue |
| DV-5 | 316/4648 | 110–111 | 0.6239 | 7.58:I/O (t = 16 min) | 0.508 | 390 (new) | No dye res. |
| DV-6 | 316/4640 | 106–110 | 0.6220 | 6.20:I/O (t = 16 min) | 0.657 | 590 (old) | No dye res. |
| DV-7 | 243/3578 | 80–82 | 0.6257 | 6.14:I/O (t = 16 min) | 0.635 | 570 (new) | Large dye res. |
| DV-8 | 292/4285 | 95–96 | 0.6392 | 6.22:I/O (t = 16 min) | 0.635 | 570 (new) | Large dye res. |

Average cycle dyeing time = 16 minutes
Average dyeing temperature ≅ 100° C.
Average $CO_2$ density (ρ) - 0.62 g/cm$^3$
Average pressure = 4300 psi = 306 atm = 310 bar
Average $CO_2$ flow rate = 6–10 gal/min After a suitable colorant material is selected, the hydrophobic textile fiber and the colorant material are each placed in a suitable containment vessel in the dyeing system and are heated in SCF—$CO_2$ under SCF pressure conditions to a temperature within the higher temperature range. The amount of $CO_2$ added will be sufficient to achieve the desired operating density, typically a value in the range of about 0.6 g/cm$^3$ to about 0.65 g/cm$^3$. The amount of colorant material added, and thus, the dye concentration used in the process, will vary depending on the desired shade and is based on the limits of solubility of dye in both the SCF—$CO_2$ and the fiber. Additionally, and preferably, the colorant material is readily or highly soluble in the SCF—$CO_2$ at the high temperature. Stated differently, within the higher temperature range, the colorant material has a high affinity for the SCF—$CO_2$ solvent.

Dyeing of the polyester initiates once the SCF—$CO_2$ flow reaches a temperature sufficient to: (1) dissolve the colorant material, typically at or above 50° C., and (2) cause the hydrophobic polymers of the hydrophobic textile fiber to be receptive to diffusion of colorant material into their interior, typically at or above 80° C. Stated differently, the hydrophobic polymers are receptive to the diffusion of colorant material into their interior at temperatures above their glass transition temperatures. The glass transition temperatures of preferred hydrophobic polymers, such those listed above, typically fall over a range of about 55° C. to about 65° C. in SCF—$CO_2$. The temperature of the process is maintained at the temperature within the higher temperature range for a predetermined period of time, such as 0 to about 45 minutes, or 0 to about 30 minutes.

The dyeing of the hydrophobic textile fiber continues by isolating the vessel containing the colorant material and cooling the process to a temperature within the lower temperature range before any venting of the SCF—$CO_2$ occurs. The term "venting" refers to the removal of $CO_2$ from the dyeing system. Thus, because the process represents a closed system, the density of the SCF—$CO_2$ is maintained at a constant level. As noted above, the colorant material is sparingly soluble in the SCF—$CO_2$ or the near-critical fluid $CO_2$ at the lower temperature. But, the dyeing rate is still high because the decrease in solubility of the dye produced by the cooling step causes the dye to partition much more in favor of the textile fiber that is being dyed. Indeed, the decreased solubility causes the dye to partition toward the textile fiber until the dye is in essence completely exhausted from the SCF—$CO_2$ dyebath. Stated differently, within the lower temperature range, the colorant material has a higher affinity for the hydrophobic textile fiber to be dyed as compared to the SCF—$CO_2$ solvent. The insolubilization of the dye and partitioning of the dye towards the hydrophobic textile fiber thus results in complete dyebath exhaustion. Additionally, isolation of the vessel containing the colorant material from the remainder of the dyeing process will prevent any residual colorant material in this vessel from entering the SCF—$CO_2$ as the dyebath is exhausted.

Once there is no dye in the bath, there is no fouling of the equipment or substrate by unwanted dye precipitation, thus reducing the crocking potential for the dyed textile fiber. There is no need for a scouring or after-clearing step for the dyed textile fiber or the dyeing equipment. Overall dye cycle time is therefore reduced.

The cooling step occurs without removal of $CO_2$ from the system by venting or expanding the SCF—$CO_2$. In sharp contrast, prior art processes are depressurized by venting $CO_2$ at elevated temperatures while there is still residual dye in the SCF—$CO_2$ dyebath. This can lead to equipment fouling and crocking of the dyed article, a common problem seen in other attempts to dye from SCF—$CO_2$.

The process of the present invention can further comprise depressurizing the process by venting after a predetermined time. Preferably, the predetermined time comprises a time after which complete exhaustion of the colorant material from the SCF—$CO_2$ dyebath is attained, for example, by cooling. More preferably, the venting of the process is carried out gradually in a series of steps or in a continuous pressure ramp. For example, the pressure in each step is preferably reduced by steps of density, (ρ), i.e., the removal of $CO_2$ at Δρ of 0.05 g/cm$^3$ every 5 minutes; or by pressure drop between 15 atm to 30 atm every 5 minutes.

Crocking in polyester textile materials dyed with colorant materials in SCF—$CO_2$ is therefore avoided by cooling, without venting or expanding, the SCF—$CO_2$ dyebath to a temperature within the lower temperature range at which the dye has a very low solubility. Yet, the temperature remains above the dyeing temperature (glass transition temperature of the hydrophobic textile substrate in SCF—$CO_2$), so that the insolubilization of the dye results in complete dyebath exhaustion. Additionally, within the lower temperature range, a suitable colorant material has a higher affinity for the hydrophobic textile fiber to be dyed as compared to the SCF—$CO_2$ solvent . This process works particularly well for dyes such as CI Disperse Blue 77 (B 77) of Table 2. Table 2 presents a list of several disperse dyes that were selected based on equilibrium solubility of the disperse dyes in $CO_2$. Dye B77 in Table 2 may be characterized as a "temperature controllable dye" as described above and in FIG. 5; and is particularly suitable for use in the process of the present invention, as described in this Example.

Abbreviations used in Table 2

B—Blue (color of dye)

ρ dye dissolve—Density of SCF—$CO_2$ in grams per cubic centimeter (g/cm$^3$) at which dye dissolves.

ρ dyeing—Density of SCF—$CO_2$ in grams per cubic centimeter (g/cm$^3$) at which dyeing is initiated.

EST. STR. DYE—Estimated strength of dye.

I/O—Inside-to-outside circuit.

NC—No crocking observed.

O/I—Outside-to-inside circuit.

$Qco_2$—Flow rate of $CO_2$ in gallons per minute (gpm).

R—Red (color of dye)

REV. FLOW—Reverse $CO_2$ flows in the expansion vessel.

$T_{cool\ down}$(° C.)—Temperature in lower temperature range at which dyeing is continued.

$T_{dyeing}$(° C.)—Temperature in higher temperature range at which dyeing is initiated.

Time (min) Dye—Time elapsed during dyeing process in minutes (min).

V—Violet (color of dye)

Y—Yellow (color of dye)

TABLE 2

| Disperse Dye | Run # | ρ dye dissolve (g/cm$^3$) | ρ dyeing (g/cm$^3$) | T (° C.) dyeing | Time (min) dye | Depressurization step | T (° C.) cool down | $Q_{CO2}$ (gpm) | REV. FLOW I/O→O/I | EST. STR. DYE | Result/ Comments |
|---|---|---|---|---|---|---|---|---|---|---|---|
| B77 | 15 | 0.39 | 0.60 | 110 | 16 | Cool without Venting or Expanding | 75 | 6.95 | Yes | 2:1 | NC |
| R167 | 20 | 0.30 | 0.54 | 106 | 48 | Vent or Expand without Cooling | 50 | 5.10 | Yes | 4:1 | NC |
| Y86 | 25 | 0.49 | 0.60 | 102 | 8 | Vent or Expand without Cooling | 75 | 5.09 | Yes | 1.8:1 | NC |
| B60 | 28 | 0.42 | 0.63 | 108 | 16 | Vent or Expand without Cooling | 75 | 4.97 | No | 2.8:1 | NC |
| V91 | 30 | 0.40 | 0.62 | 106 | 8 | Vent or Expand without Cooling | 65 | 5.35 | Yes | 1.6:1 | NC |
| R324 | 34 | 0.35 | 0.66 | 110 | 16 | Vent or Expand without Cooling | 80 | 5.5 | No | 1.1:1 | NC |
| B102 | 36 | 0.35 | 0.67 | 110 | 16 | Vent or Expand without Cooling | no | 5.0 | No | | NC |
| B165:1 | 35 | 0.39 | 0.66 | 110 | 8 | Vent or Expand without Cooling | 80 | 4.9 | Yes | 2.8:1 | NC |
| B118 | 32 | 0.33 | 0.66 | 110 | 24 | Vent or Expand without Cooling | 90 | 4.5 | No | 2:1 | NC |
| Y42 | 39 | 0.37 | 0.66 | 106 | 16 | Vent or Expand without Cooling | 90 | 5.6 | No | | NC |
| Burgundy | 38 | 0.40 | 0.68 | 100 | 16 | Vent or Expand without Cooling | 79 | 5.0 | No | | NC |

Referring now to the drawings, wherein like reference numerals refer to like parts throughout, a system suitable for carrying out the process of the instant invention is referred to generally at 10. In the following detailed description, the parts of system 10 that are primarily involved in the process of the present invention are described. Additionally, a legend describing other parts of system 10 is provided below.

Figure 1:
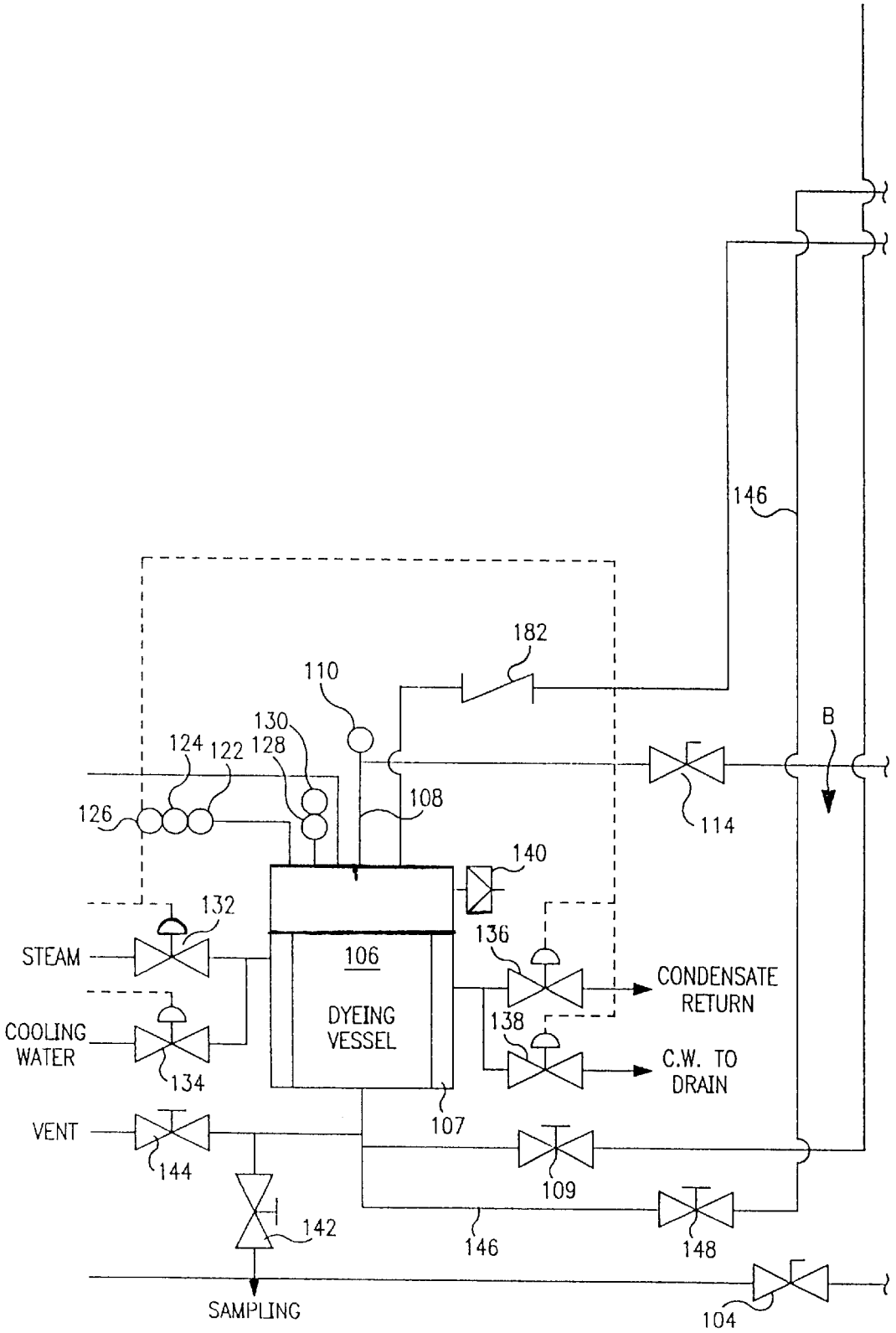
FIG. 1 is a detailed schematic of a system suitable for use in the SCF—$CO_2$ dyeing process of the present invention.
Figure 1:
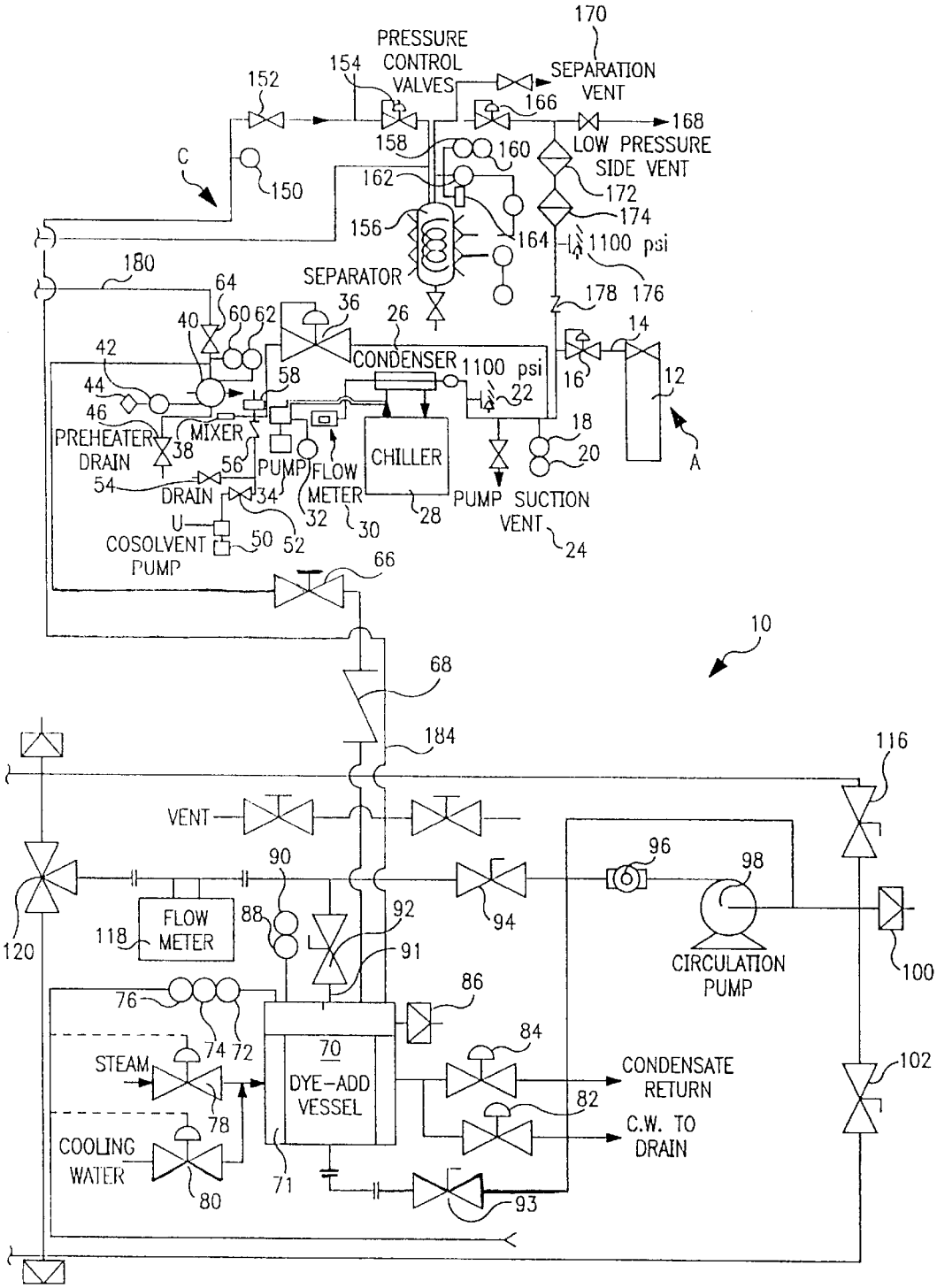
Figure 2:
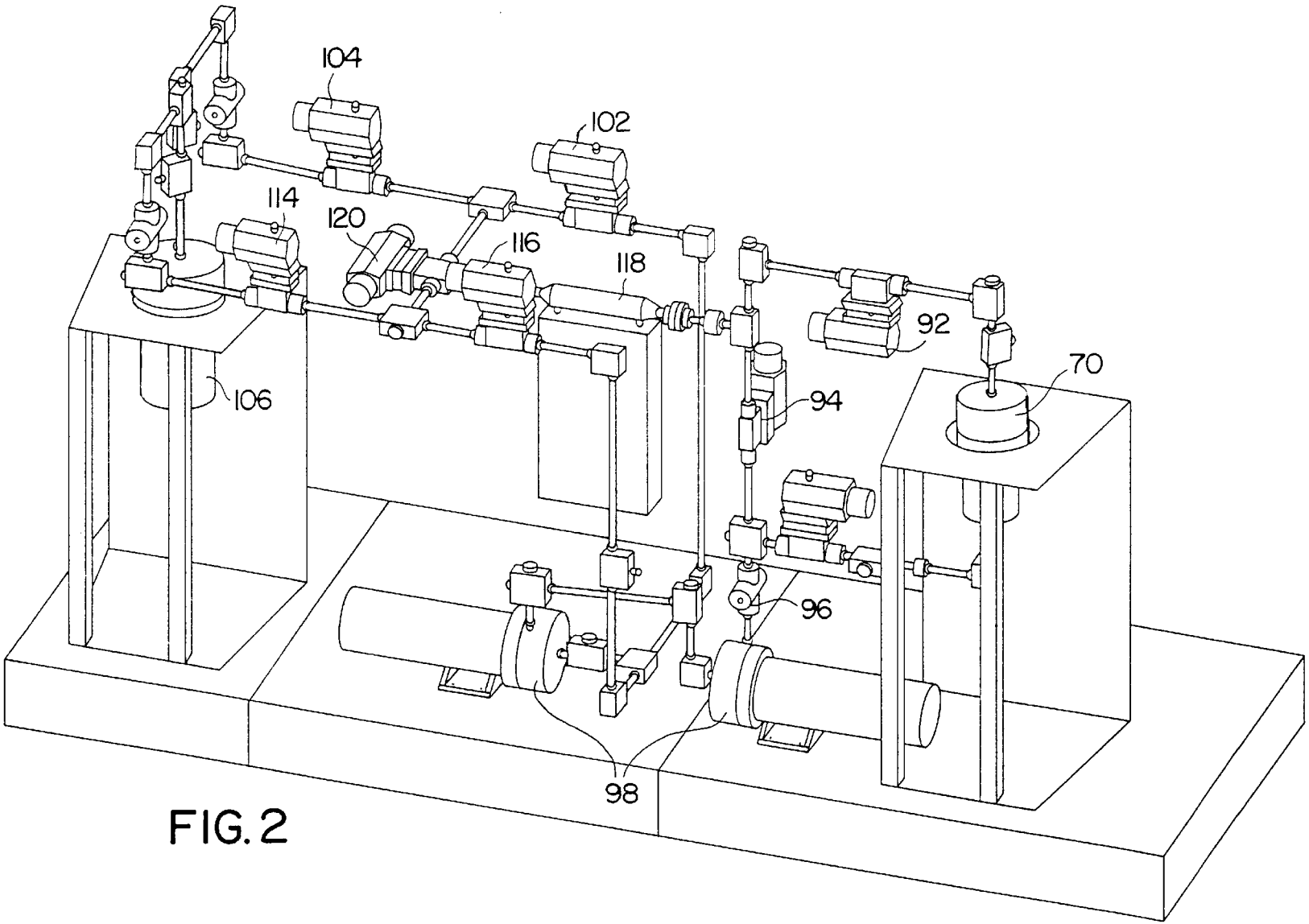
FIG. 2 is a detailed perspective view of a system suitable for use in the SCF—$CO_2$ dyeing process of the present invention.

Referring particularly to FIGS. 1 and 2, operation and control of heating/cooling of the SCF—$CO_2$ dyeing system 10 preferably encompasses three distinct equipment subsystems. The subsystems include filling and pressurization subsystem A, dyeing subsystem B, and venting subsystem C. Carbon dioxide is introduced into system 10 via $CO_2$ supply cylinder 12. Preferably, supply cylinder 12 contains liquid carbon dioxide. Thus, liquid $CO_2$ enters the filling and pressurization subsystem A from the supply cylinder 12 through line section 14 and regulating valve 16 and is cooled in condenser 26 by a water/glycol solution supplied by chiller 28. The $CO_2$ is cooled to assure that it remains in a liquid state and at a pressure sufficiently low to prevent cavitation of system pressurization pump 34.

Continuing with FIGS. 1 and 2, turbine flow meter 30 measures the amount of liquid $CO_2$ charged to dyeing system 10. Pump 34 increases the pressure of the liquid $CO_2$ to a value above the critical pressure of $CO_2$ but less than the operating pressure for the dyeing system, typically about 4500 psig. A side-stream of water/glycol solution from chiller 28 provides cooling for pump 34. Control valve 36 allows pump 34 to run continuously by opening to bypass liquid $CO_2$ back to the suction side of pump 34 once the system pressure set point has been reached. This valve closes if the system pressure falls below the set point that causes additional liquid $CO_2$ to enter the dyeing subsystem B. If co-solvent is potentially used, it is injected into the liquid $CO_2$ stream by pump 50 at the discharge of pump 34 and mixed in by static mixer 38. All of the process steps described herein remain unchanged by the introduction of a co-solvent.

Continuing with FIGS. 1 and 2, liquid $CO_2$ leaving mixer 38 enters electrical pre-heater 40 where its temperature is increased. Heated and pressurized $CO_2$ may enter the dyeing subsystem B through needle valve 66 and into dye-add vessel 70; through needle valve 64 and into dyeing vessel 106; or through both of these paths. Typically, dyeing subsystem B is filled and pressurized simultaneously through both the dye-add and dyeing vessels 70 and 106, respectively.

Once a sufficient quantity of liquid $CO_2$ has been charged to dyeing subsystem B to achieve the operating density, typically a value in the range of 0.6 to 0.65 g/cm$^3$, circulation pump 98 is activated. Pump 98 circulates liquid $CO_2$ through dye-add vessel 70, which contains a weighed amount of colorant material, and then through dyeing vessel 106, which contains the package of yarn to be dyed. Once circulation is started, heating of subsystem B is initiated by opening control valves 78 and 84 to supply steam to and remove condensate, respectively, from the heating/cooling jacket 71 on dye-add vessel 70. Similarly, control valves 132 and 136 are opened to supply steam to and remove condensate from, respectively, the heating/cooling jacket 107 on dyeing vessel 106. Commercial practice would utilize a heat exchanger in the circulation loop to provide for heating of the SCF—$CO_2$ rather than relying on heating through the vessel jackets 71 and 107. Heating is continued until the system passes the critical temperature of $CO_2$ and reaches the operating, or dyeing, temperature, typically about 100° C. to about 130° C.

SCF—$CO_2$ leaving circulation pump 98 passes through sight glass 96 and is diverted, by closing ball valve 94 and opening ball valve 93, through dye-add vessel 70 where dye is dissolved. Dye-laden SCF—$CO_2$ passes out of the dye-add vessel 70 through ball valve 92 and flow meter 118 to ball valve 120. Ball valve 120 is a three-way valve that diverts the SCF—$CO_2$ flow to the inside or outside of the package loaded in dyeing vessel 106 depending on the direction in which it is set. If ball valve 120 is set to divert flow in the direction of ball valve 104, and ball valve 104 is open and ball valve 102 is closed, then all of the SCF—$CO_2$ flow proceeds to the inside of the dye spindle (not shown in FIGS. 1 and 2). The flow continues from the inside to the outside of the dye spindle, from the inside to the outside of the dye tube (not shown in FIGS. 1 and 2) on which the polyester yarn package is wound and out through the polyester yarn package to the interior of dyeing vessel 106. The SCF—$CO_2$ flow passes out of dyeing vessel 106, through open ball valves 114 and 116 to the suction of pump 98, completing a circuit for inside-to-outside dyeing of the polyester yarn package.

If ball valve 120 is set to divert flow in the direction of ball valve 114, and ball valve 114 is open and ball valve 116 is closed, then all of the SCF—$CO_2$ flow proceeds to the interior of dyeing vessel 106 and the outside of the polyester yarn package. The flow passes through the polyester yarn package, continues from the outside to the inside of the dye tube on which the yarn is wound and then passes from the outside to the inside of the dye spindle. The SCF—$CO_2$ flow exits the interior of the dye spindle and passes through open ball valves 104 and 102 to the suction of pump 98, which completes a circuit for outside-to-inside dyeing of the polyester yarn package.

Dyeing of the polyester initiates once the SCF—$CO_2$ flow passing the dye-add vessel 70 reaches a temperature sufficient to: (1) dissolve colorant material, typically at or above 50° C., and (2) cause the polyester to be receptive to diffusion of colorant material into its interior, typically at or above 80° C. The dye-laden SCF—$CO_2$ flow is held at values ranging from values of 1 gallon per minute (GPM)/lb of polyester or less, to values greater than 15 GPM/lb of polyester. As described in Tables 1A, 1B and 1C above, the dye-laden SCF—$CO_2$ flow is periodically switched between the inside-to-outside (I/O) circuit and the outside-to-inside (O/I) circuit to promote uniformity of dyeing of the polyester yarn; e.g., 6 min./2 min. I/O, 6 min./4 min. I/O, 5 min./5 min. I/O, etc. This dyeing process is continued with system 10 held at the dyeing temperature, typically about 100° C. to about 130° C., until the colorant material is exhausted onto the polyester yarn to produce an even distribution of the desired shade, typically around 30 minutes.

Once the colorant material is exhausted onto the polyester yarn, as dictated by its solubility and affinity characteristics, the dyeing system is cooled without venting. This depressurization step causes the dye remaining in solution in the SCF—$CO_2$ to exhaust into the polyester fiber.

Before initiation of cooling of the dyeing process, dye-add vessel 70 is isolated for the remainder of the dyeing process by closing ball valves 92 and 93 while opening ball valve 94. This action allows the SCF—$CO_2$ to maintain a circulation loop through dyeing vessel 106, but not through dye-add vessel 70. This will prevent any additional dye remaining in dye-add vessel 70 from going into solution in the SCF—$CO_2$ and will prevent the introduction of any residual dye that might remain in dye-add vessel 70 into the SCF—$CO_2$ during the cooling and/or venting steps.

Cooling is initiated by continuing the SCF—$CO_2$ circulation while cooling dyeing vessel 106. Thus, the action of circulation pump 98 maintains system flow during cooling. Additionally, because system 10 is a closed system, the density of the SCF—$CO_2$ remains constant during the cooling step. Cooling of dyeing vessel 106 is accomplished by closing control valves 132 and 136 to shut off the steam supply and condensate removal, respectively, to jacket 107. Control valves 134 and 138 are opened to inject into and remove cooling water from, respectively, jacket 107. Cooling of dye-add vessel 70 is accomplished by closing control valves 78 and 84 to shut off the steam supply and condensate removal, respectively, to jacket 71. Control valves 80 and 82 are opened to inject into and remove cooling water from, respectively, jacket 71. Commercial practice would utilize a heat exchanger in the circulation loop to provide for cooling of the SCF—$CO_2$ rather than relying on cooling through the vessel jackets 71 and 107. To minimize heat up time between subsequent dyeings, the dyeing and dye-add vessels would not be cooled in commercial practice so that the walls and lids of these vessels would retain as much heat as possible.

Once the system is cooled to the target temperature in the lower temperature range, preferably 70–75° C., and substantially complete dye exhaustion is attained, venting is initiated. Venting is accomplished by opening needle valve 109 to provide a flow path from the dyeing vessel 106 to control valve 154. Control valve 154 is opened to set the pressure in dyeing subsystem B and control valve 166 is opened to set the pressure in separator vessel 156. By adjusting control valves 154 and 166 appropriately, the pressure in the dyeing vessel 106 is reduced at a controlled rate, typically with average values in the range of 0.01 to 1.0 lb/min. Dye-add vessel 70 is isolated during venting to prevent any additional dye remaining in dye-add vessel 70 from going into solution in the SCF—$CO_2$. Isolation of dye-add vessel 70 is accomplished by closing ball valves 92 and 93 while opening ball valve 94 to maintain a circulation loop for the dyeing vessel.

During venting SCF—$CO_2$ flows from dyeing subsystem B through control valve 154 and into separator vessel 156 of venting subsystem C. In separator vessel 156 the pressure is sufficiently low so that the $CO_2$ is in the gaseous phase and any remaining colorant material will no longer be soluble in it The colorant material solids collect in separator vessel 156 and gaseous $CO_2$ exits through control valve 166. Once the gaseous $CO_2$ passes through control valve 156 it may vented to atmosphere by opening needle valve 168. The gaseous $CO_2$ may also be recycled to filling and pressurization subsystem A by keeping needle valve 168 closed so that the gaseous $CO_2$ passes through filters 172 and 174. Filters 172 and 174 collect any minute amounts of solids that may have escaped separator vessel 156 with the gaseous $CO_2$ flow. The gaseous $CO_2$ exiting filters 172 and 174 passes through check valve 178 and enters filling and pressurization subsystem A for re-use in system 10.

Figure 3:
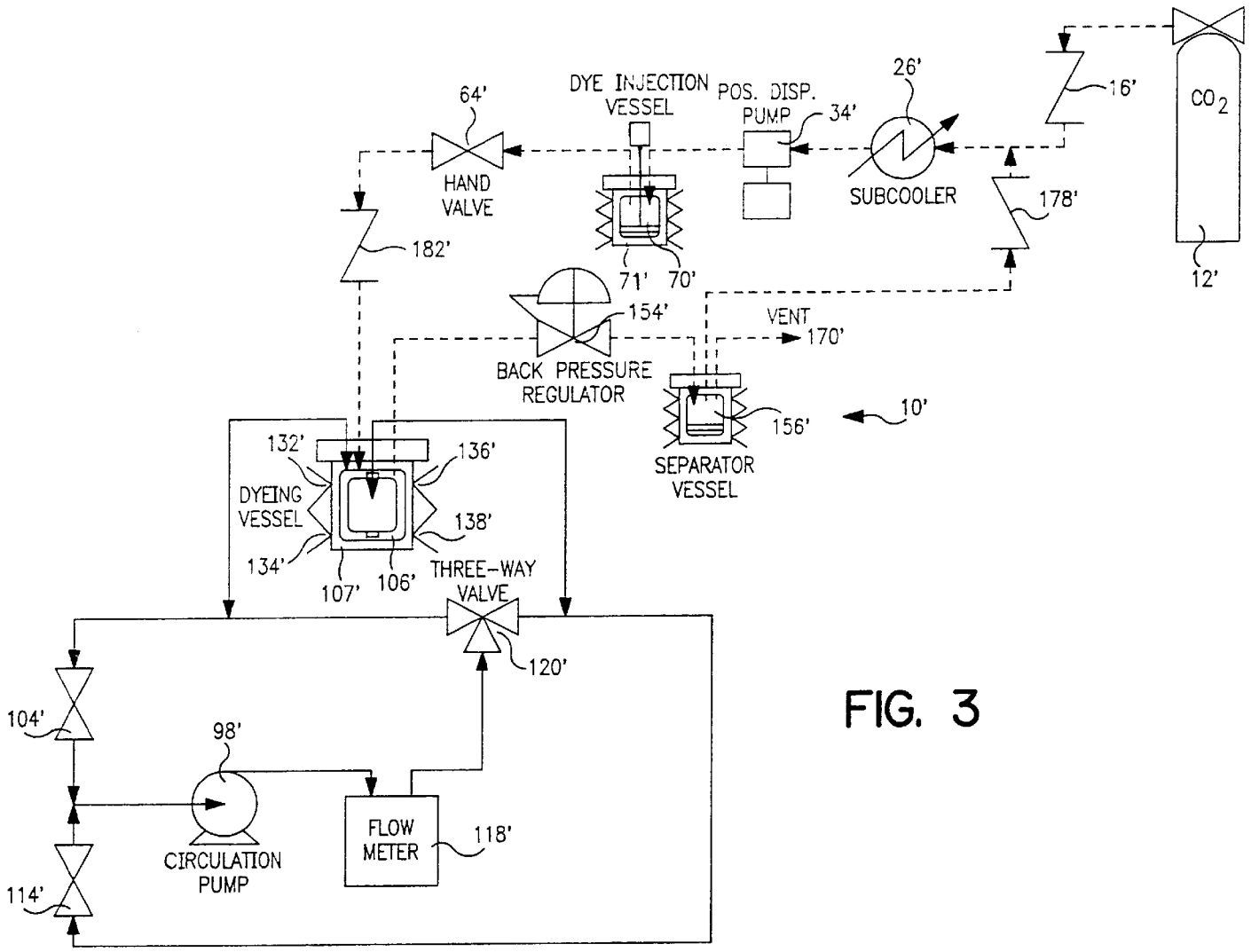
FIG. 3 is a schematic of an alternative embodiment of a system suitable for use in the SCF—$CO_2$ dyeing process of the present invention.

Referring now to FIG. 3, an alternative system 10' for use in the SCF—$CO_2$ dyeing process of the present invention is depicted schematically. Generally, however, system 10' works in a similar manner as system 10 described above and as depicted in FIGS. 1 and 2. System 10' includes a $CO_2$ cylinder 12', from which $CO_2$ flows through check valve 16' to a cooling unit 26'. $CO_2$ is cooled and pressurized within cooler 26' and then is pumped, using positive displacement pump 34', into dye injection vessel 70'. Prior to introduction of $CO_2$ into vessel 70', a dyestuff is placed within vessel 70'. Thus, when $CO_2$ is introduced into vessel 70' the dyestuff is suspended and/or dissolved within the carbon dioxide. The action of pump 34' drives the carbon dioxide/dye solution or suspension out of dye injection vessel 70' through a hand valve 64' and a check valve 182' into a dyeing vessel 106' which contains the textile fibers to be dyed. Dyeing vessel 106' is pressurized and heated to SCF dyeing conditions prior to the introduction of the carbon dioxide/dye solution or suspension. Thus, when the carbon dioxide/dye solution or suspension enters dyeing vessel 106', the dye either remains in solution or dissolves in the SCF—$CO_2$, as the case may be. Steam and/or cooling water are introduced to jacket 107' of dyeing vessel 106' via valves 132' and 134', respectively. Thus, appropriate temperatures for dye dissolution and dyeing are achieved in vessel 106'. Particularly, cooling water is introduced via valve 134' to provide a lower temperature at which the dye is sparingly soluble in SCF—$CO_2$ or near-critical fluid $CO_2$. At this temperature, dye partitions toward the textile fibers within dyeing vessel to be dyed. During and after dyeing, any condensate resulting from the introduction of steam through valve 132' is exported through vent 136' and any water introduced via valve 134' is exported through drain 138'.

Continuing with particular reference to FIG. 3, during dyeing, the SCF—$CO_2$/dye solution is circulated into and out of vessel 106' via circulation pump 98', valves 104' and 114', and 3-way valve 120' in a manner analogous to that described above for system 10, valves 104 and 114, and 3-way valve 120. Flow meter 118' is placed in system 10' between circulation pump 98' and 3-way valve 120' so that the flow rate of SCF—$CO_2$/dye solution can be monitored. Dyeing is thus facilitated by circulation subsystem. Further, the action of circulation pump 98' maintains system flow during cooling.

Continuing with particular reference to FIG. 3, after a predetermined time, preferably when complete dyebath exhaustion is observed, SCF—$CO_2$ is removed from dyeing vessel 106' and flows through back pressure regulator 154'. At this point, the pressure of the process is reduced and $CO_2$ within the system is introduced into separator vessel 156'. Any residual dye, likely a small amount, is removed from the $CO_2$ in separator vessel 156'. $CO_2$ then may be vented through vent 170'. Alternatively, $CO_2$ may be recycled back into system 10' via check valve 178'.

Figure 4:
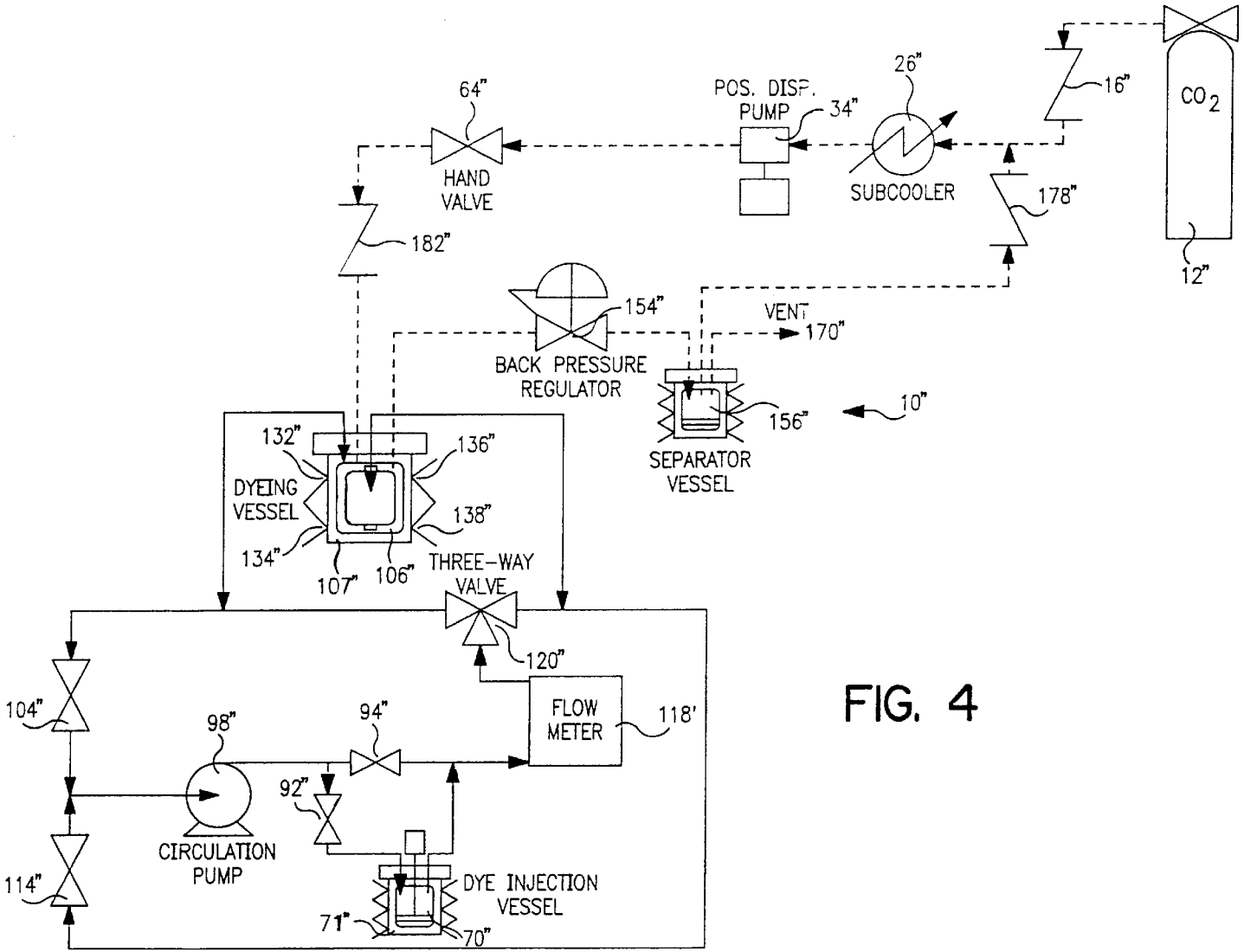
FIG. 4 is a schematic of another alternative embodiment of a system suitable for use in the SCF—$CO_2$ dyeing process of the present invention.

Referring now to FIG. 4, another alternative embodiment of a suitable system for use in the process of the instant invention is described. System 10" includes $CO_2$ cylinder 12". $CO_2$ flows from cylinder 12" through check valve 16" into subcooler 26". The temperature of the $CO_2$ is reduced within subcooler 26" to assure that is remains in a liquid state and at a pressure sufficiently low to prevent cavitation of positive displacement pump 34". The positive displacement pump 34" then drives the $CO_2$ through hand valve 64", then through a check valve 182", into dyeing vessel 106". Dyeing vessel 106" includes the textile fibers to be dyed.

Continuing with particular reference to FIG. 4, dyeing vessel 106" is pressurized and heated to produce $CO_2$ at SCF temperature and pressure. SCF—$CO_2$ is then exported from vessel 106" using circulation pump 98" and valves 104" and 114" in a manner analogous to that described above for system 10 and valves 104 and 114. SCF—$CO_2$ is introduced via valve 92" into a dye injection vessel 70" containing a suitable dye. The dye is then dissolved in SCF—$CO_2$. Circulation pump 98" drives the SCF—$CO_2$ dye solution from vessel 70" through flow meter 118" and 3-way valve 120" back into dyeing vessel 106" wherein dyeing of the textile fibers is accomplished. During dyeing, steam and/or cooling water are introduced to jacket 107" of dyeing vessel 106" via valves 132" and 134", respectively. Thus, appropriate temperatures for dye dissolution and dyeing are achieved in vessel 106". Particularly, cooling water is introduced via valve 134" to provide a dyebath at a lower temperature at which the dye is sparingly soluble in the resulting SCF—$CO_2$ or near-critical fluid $CO_2$ dyebath. At this temperature, dye partitions toward the textile fibers that is being dyed within dyeing vessel 106". During and after dyeing, any condensate resulting from the introduction of steam through valve 132" is exported through vent 136" and any water introduced via valve 134" is exported through drain 138".

After a predetermined time, preferably when complete exhaustion of the SCF—$CO_2$ dyebath is observed, the SCF—$CO_2$ dyebath is removed from vessel 106" to back pressure regulator 154". The pressure of the process is then reduced using regulator 154" and the resulting $CO_2$ phase is then introduced into separator vessel 156". In separator vessel 156" the pressure is further reduced so that any residual dye, likely a small amount, is deposited within separator vessel 156" and the resulting dye-free $CO_2$ gas is removed from separator vessel 156". Particularly, the dye-free $CO_2$ gas may be vented using vent 170" or may be recycled back into system 10" via check valve 178". The efficiency of the process of this invention is thus demonstrated.

EXAMPLE 2

Density Controllable Dyes

As disclosed in Example 1, crocking in hydrophobic textile fibers, such as polyester fibers, dyed with colorant materials in SCF—$CO_2$ is avoided by cooling, without venting, the SCF—$CO_2$ dyebath to a temperature at which the dye has a very low solubility where the temperature remains above the dyeing temperature (glass transition temperature of the hydrophobic textile fiber in SCF—$CO_2$) so that the insolubilization of the dye results in complete dyebath exhaustion. Such dyes are characterized above as "temperature controllable dyes".

However, there are other dyes, such as CI Disperse Yellow 86, which remain somewhat soluble even at a low temperature, such as 40° C. There are also dyes, such as CI Disperse Red 167, which contain component isomers which remain soluble even at low temperature, such as 40° C. Additional examples are set forth in Table 2 above. In accordance an alternative embodiment of the present invention as disclosed in this Example, crocking problems associated with utilizing such dyes in SCF—$CO_2$ dyeing may be avoided by controlling the density of the SCF—$CO_2$ dyebath. Such dyes may be characterized as "density-controllable dyes", as described above and in FIG. 5.

The preferred steps of this alternate embodiment of the present invention comprise placing the substrate or textile fiber to be dyed and the colorant material each in suitable containment vessels in dyeing system or apparatus, such as system 10 disclosed in Example 1 above. The dyeing system is then filled with $CO_2$ to a density of about 0.1 g/cm$^3$ and to a dyeing temperature of, for example, about 100° C. Bath circulation is then begun at the desired flow rate, which typically ranges, for example, from about 6 to about 20 gallons per minute (GPM).

The density of the SCF—$CO_2$ is then raised to a final desired dyeing density by adding $CO_2$ to the dyeing system. Preferably, the desired density falls with in a density range of about 0.4 g/cm$^3$ to about 0.7 g/cm$^3$. More preferably, the desired density comprises about 0.62 g/cm$^3$. As the SCF—$CO_2$ density increases, the colorant material begins to dissolve in the SCF—$CO_2$. Once the desired density is attained, the dyeing cycle begins and is continued for 30 to 45 minutes to achieve equilibrium or near equilibrium in the fiber and dyebath.

The density is then reduced slowly over time (e.g., 10 minutes) to a lower density, such as a density falling within a density range comprising about 0.3 g/cm$^3$ to about 0.5 g/cm$^3$, while holding temperature at or near the dyeing temperature. Preferably, the density within the lower density range comprises about 0.45 g/cm$^3$. The dyeing temperature corresponds to a temperature within the high temperature range set forth in the embodiment of the invention described in Example 1 above. Optionally, the alternative embodiment of the process of this invention is then run until exhaustion, which preferably occurs in 0 to about 8 to 10 minutes, but may also occur from 0 to about 30 to about 45 minutes, as described in Table 3.

The reduction in the density of the SCF—$CO_2$ is preferably accomplished by venting or expanding the process gradually in a series of steps or in a continuous pressure reduction ramp without reducing the process temperature. For example, the venting is preferably accomplished by removal of $CO_2$ by steps of density, ($\rho$), i.e., $\Delta\rho$ of 0.05 g/cm$^3$ every 5 minutes, or by pressure drop between 15 atm to 30 atm every 5 minutes. Table 3 further characterizes depressurization by venting or expansion of the alternative process of the present invention.

TABLE 3

ALTERNATIVE EMBODIMENT OF SCF-$CO_2$ DYEING PROCESS
Process Venting
System Volume: 10 liters (approx.)

| Time (min) | Pressure (psig) | Temperature (approx.) (° C.) | Density (g/cm$^3$) | System Mass (kg) | System Mass (lb) | Change in Mass (lb) | Flow Rate (lb/min) |
|---|---|---|---|---|---|---|---|
| 0 | 4500 | 110 | 0.62 | 6.2 | 13.64 | — | — |
| 5 | 4265 | 110 | 0.58 | 5.8 | 12.76 | 0.88 | 0.176 |
| 10 | 3962 | 112 | 0.55 | 5.5 | 12.10 | 0.66 | 0.132 |
| 15 | 3720 | 113 | 0.50 | 5.0 | 11.00 | 1.10 | 0.22 |
| 20 | 3198 | 113 | 0.45 | 4.5 | 9.90 | 1.10 | 0.22 |
| 25 | 3061 | 114 | 0.40 | 4.0 | 8.80 | 1.10 | 0.22 |
| 30 | 2776 | 114 | 0.35 | 3.5 | 7.70 | 1.10 | 0.22 |
| 35 | 2242 | 114 | 0.30 | 3.0 | 6.60 | 1.10 | 0.22 |

The temperature of the alternative embodiment of the process of the present invention may then optionally be reduced to clear the bath according to the temperature reduction step described above in Example 1 to a temperature that is still within the dyeing range, i.e., remains above the dyeing temperature (glass transition temperature of the hydrophobic textile fiber in SCF—$CO_2$). Insolubilization of the colorant material, and subsequent precipitation of the dye onto the article to be dyed, is thereby accomplished.

Thus, in accordance with the present invention, depending on the solubility and affinity characteristics of the colorant material, the dyeing process may either be cooled without venting and then vented to atmospheric pressure or vented without cooling and then cooled and vented to atmospheric pressure. The cooling/venting step or venting/cooling step causes most of the dye remaining in solution in the SCF—$CO_2$ to exhaust into the polyester fiber. In the case that the venting/cooling process is required rather than the cooling/venting process, the operations are the same as for the cooling/venting process set forth in Example 1 above with respect to the preferred embodiment, but are simply reversed.

EXAMPLE 3

Temperature Control Profile

The solubility behavior of dyes in SCF—$CO_2$ is a factor in the levelness of dyed textile materials. To date, prior art SCF—$CO_2$ dyeing processes have sought to maximize the amount of dye in solution at all times. Such an approach is not necessarily the optimum in terms of achieving a level dyeing in the minimum time. Indeed, another approach involves careful control of SCF—$CO_2$ density and temperature or use of a dye specific dosing strategy so that dye concentration at all times is favorable to rapid equilibrium for dye uptake by the fiber. Under these circumstances, unlevel dyeing problems, such as shading and streaking, are minimized. Additionally, less time at dyeing temperatures will be required to correct such problems. Such an approach is described herein.

Thus, the supercritical fluid SCF—$CO_2$ dyeing processes of the present invention can further comprise initiating the respective dyeing processes according to a predetermined temperature control profile. While the processes described in Examples 1 and 2 above produce high quality and improved dyeings of hydrophobic textile materials as compared to prior art processes, initiating the dyeing process according to a selected temperature profile improves levelness of the dyeings and contributes significantly to a reduction in the costs associated with the production of commercial scale dyeing systems.

Figure 6:
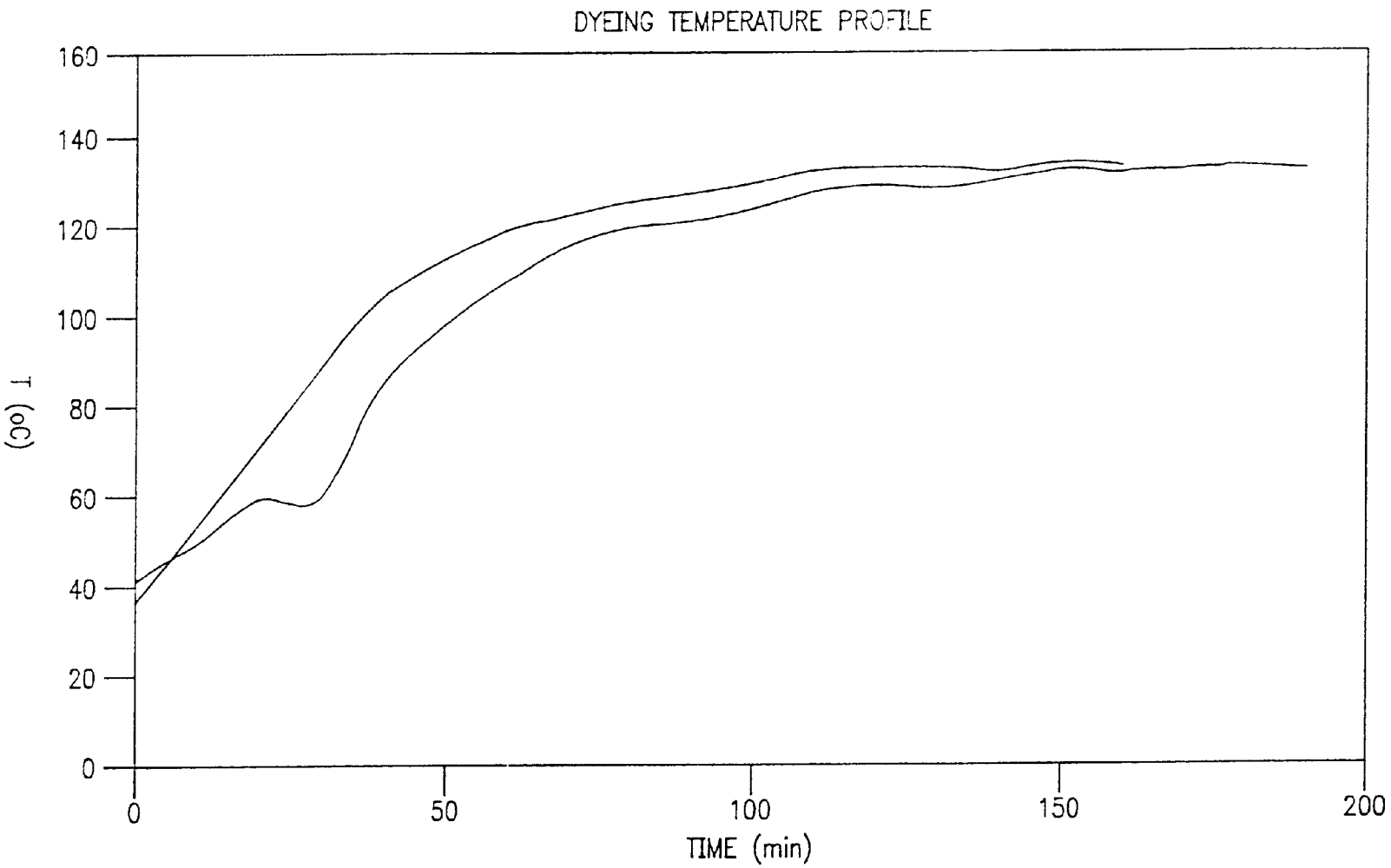
FIG. 6 is a graph which shows an exemplary temperature control profile for a dyeing run.

According to an exemplary predetermined temperature control profile, the dyeing system is set to a temperature which is below the $T_g$ of the hydrophobic textile fiber to be dyed. For example, the temperature can be set to about 40° C. Then, the temperature is raised at a controlled rate from about 40° C. to about 130° C. or higher. FIG. 6 provides a typical temperature control profile for a dyeing run using the exemplary dye CI Disperse Blue 77 in SCF—$CO_2$. The rate of temperature rise on the y-axis plot is about 1° C./minute to about 1.5° C./minute. During this time the pressure rises from about 2700 pounds per square inch (PSI) to about 4500 PSI, during which the $CO_2$ density is held constant. For example, $CO_2$ density is held constant at about 0.55 g/cm$^3$, and the solublization of the disperse dye in SCF—$CO_2$ increases as temperature increases.

Although applicants do not wish to be bound to any particular theory of the invention, it is believed that this profile promotes initial level sorption and leads to a more level dye for two reasons. Firstly, the dye is less soluble at low temperature and therefore the initial dyeing strike rate (kinetic mass transfer velocity) is slower, which avoids concentration gradients in the hydrophobic textile fiber package to be dyed. Secondly, the polyester $T_g$ is not exceeded, which reduces the kinetic absorption rate constant and thus limits the rate of dye uptake.

By way of elaboration, introduction of the dye at lower process temperature substantially reduces both the strike rate and affinity of the dye for the fiber and typically results in lower dye concentration in the $CO_2$. These conditions cause the colorant material to go on the fiber more slowly and to reach an equilibrium value for concentration in the fiber that is lower than that which results when the dye is introduced to the fiber at a high process temperature, such as 110° C. Moreover, since dye introduction continues with progressive increase in process temperature, conditions remain favorable during the process to maximize dye equilibrium throughout the fiber package to be dyed. Levelness is thus enhanced, and any risk of shading or streaking is minimized.

Further, with the increase in process temperature, the desorption rate constant will increase relative to the absorption rate constant. This characteristic favors increased removal of dye from sites within the fiber package with darker shade and transport to sites within the fiber package with lighter shade, thereby leveling the package. Additionally, introduction of the dye at a lower process temperature increases the amount of time that the fiber encounters dye within the process (i.e. dyeing time), which also improves package levelness.

Thus, the slower exhaust of the SCF—$CO_2$ dye bath results in better levelness. The complete dyeing cycle achieves a dye uptake of about 99%, and takes the heat-up time plus 30 minutes (running at 130° C.) with reverse flows, 2 (I) times 2.5 (O), at 1 to 6 gpm per lb of yarn. Although applicants do not wish to be bound by any particular theory of operation, it appears that the ratio of temperature rise and dyeing temperature affect the levelness of dyeing. A lower rate of temperature rise (start from about 40° C. to about 130° C.) favors more even uptake of dye before sorption equilibrium is set up.

As a consequence of the extended heating time, the dyeing cycle time increases as compared to the embodiment presented above, which also benefits levelness. Furthermore, a higher temperature of dyeing (e.g. 130° C. or higher) increases migration/diffusion of dye from inside and outside to the middle of the hydrophobic textile fiber package to be dyed. Dyeing will also be level either in terms of rate of uptake or in terms of extent of uptake, i.e. "kinetic or thermodynamic" terms.

Deeper dyeing and less dye shading and streaking at a dyeing temperature of t=130° C., which is far above the $T_g$ for hydrophobic textile fiber in SCF—$CO_2$, have been observed. Further, when using the temperature profile according to the present invention, the dyeing machine is almost completely clean, i.e. there is little dye residue remaining in the machine after the dyeing process is completed. The increase in levelness of the dyed package may allow for the use of lower flow rates (e.g. 1 to 6 GPM per lb. of yarn as opposed to 20 GPM per lb. as described above) with associated economic benefits in the cost of machinery. Thus, through the use of a temperature profile as described herein, costs associated with the production of a commercial scale SCF—$CO_2$ dye machine may be substantially reduced.

TABLE 4

LEGEND FOR FIGS. 1 AND 2

| Item No. | Name |
|---|---|
| 10 | Supercritical $CO_2$ Dyeing System |
| 12 | $CO_2$ Supply Cylinder |
| 14 | Line Section |
| 16 | Pressure Regulating Valve |
| 18 | Pressure Indicator |
| 20 | Pressure Alarm |
| 22 | Pressure Relief Valve |
| 24 | Needle Valve |
| 26 | Condenser (Shell-in-Tube Heat Exchanger) |
| 28 | Chiller |
| 30 | Turbine Flow Meter |
| 32 | Temperature Element (Indicator) |
| 34 | System Pressurization Pump (Positive Displacement) |
| 36 | Pressure Control Valve |
| 38 | Static Mixer |
| 40 | Electric Preheater |
| 42 | Temperature Alarm |
| 44 | Over-Temperature Switch |
| 46 | Needle Valve |
| 50 | Co-Solvent Pump (Positive Displacement) |

TABLE 4-continued

LEGEND FOR FIGS. 1 AND 2

| Item No. | Name |
|---|---|
| 52 | Needle Valve |
| 54 | Needle Valve |
| 56 | Check Valve |
| 58 | Rupture Disk |
| 60 | Temperature Element (Indicator) |
| 62 | Temperature Controller |
| 64 | Needle Valve |
| 66 | Needle Valve |
| 68 | Check Valve |
| 70 | Dye-Add Vessel |
| 71 | Dye-Add Vessel Jacket |
| 72 | Temperature Element (Indicator) |
| 74 | Temperature Alarm |
| 76 | Temperature Controller |
| 78 | Control Valve (Temperature-Controlled) |
| 80 | Control Valve (Temperature-Controlled) |
| 82 | Control Valve (Temperature-Controlled) |
| 84 | Control Valve (Temperature-Controlled) |
| 86 | Rupture Disk |
| 88 | Pressure Indicator |
| 90 | Pressure Alarm |
| 91 | Line Section |
| 92 | Ball Valve (2-Way) |
| 93 | Ball Valve |
| 94 | Ball Valve (2-Way) |
| 96 | Sight Glass |
| 98 | Circulation Pump (Centrifugal) |
| 100 | Rupture Disk |
| 102 | Ball Valve (2-Way) |
| 104 | Ball Valve (2-Way) |
| 106 | Dyeing Vessel |
| 107 | Dyeing Vessel Jacket |
| 108 | Line Section |
| 109 | Needle Valve |
| 110 | Pressure Indicator |
| 114 | Ball Valve (2-Way) |
| 116 | Ball Valve (2-Way) |
| 118 | Coriolis Flow Meter |
| 120 | Ball Valve (3-Way) |
| 122 | Temperature Element (Indicator) |
| 124 | Temperature Alarm |
| 126 | Temperature Controller |
| 128 | Pressure Indicator |
| 130 | Pressure Alarm |
| 132 | Control Valve (Temperature-Controlled) |
| 134 | Control Valve (Temperature-Controlled) |
| 136 | Control Valve (Temperature-Controlled) |
| 138 | Control Valve (Temperature-Controlled) |
| 140 | Rupture Disk |
| 142 | Needle Valve |
| 144 | Needle Valve |
| 146 | Line Section |
| 148 | Needle Valve |
| 150 | Temperature Element (Indicator) |
| 152 | Needle Valve |
| 154 | Pressure Control Valve |
| 156 | Separator Vessel |
| 158 | Pressure Indicator |
| 160 | Pressure Alarm |
| 162 | Temperature Element (Indicator) |
| 164 | Rupture Disk |
| 166 | Pressure Control Valve |
| 168 | Needle Valve |
| 170 | Needle Valve |
| 172 | Filter |
| 174 | Filter |
| 176 | Pressure Relief Valve |
| 178 | Check Valve |
| 180 | Line Section |
| 182 | Check Valve |
| 184 | Line Section |

It will be understood that various details of the invention may be changed without departing from the scope of the invention. Furthermore, the foregoing description is for the purpose of illustration only, and not for the purpose of limitation—the invention being defined by the claims.

What is claimed is:

1. A process for dyeing a hydrophobic textile fiber with a colorant material in SCF—$CO_2$, the process comprising the steps of:

(a) selecting a colorant material according to a solubility path for the colorant material in SCF—$CO_2$ wherein the selected colorant material is relatively more soluble in SCF—$CO_2$ at a first temperature range and relatively less soluble in SCF—$CO_2$ or near-critical fluid $CO_2$ at a second temperature range, wherein the first temperature range is higher than the second temperature range;

(b) heating the hydrophobic textile fiber and the colorant material in SCF—$CO_2$ under SCF pressure conditions to a temperature within the first temperature range to initiate dyeing; and (c) dyeing the hydrophobic textile fiber by cooling the process to a temperature within the second temperature range without venting the SCF—$CO_2$, whereby SCF—$CO_2$ density remains constant.

2. The process of claim 1, wherein the colorant material comprises press-cake solid particles which have no additives.

3. The process of claim 1, wherein the first temperature range comprises about 60° C. to about 200° C.

4. The process of claim 3, wherein the first temperature range comprises about 90° C. to about 140° C.

5. The process of claim 4, wherein the first temperature range comprises about 100° C. to about 130° C.

6. The process of claim 1, wherein the second temperature range comprises a temperature range near the glass transition temperature of the hydrophobic textile fiber.

7. The process of claim 1, wherein the second temperature range comprises a range in which the colorant material has a relatively greater affinity for the hydrophobic textile fiber than for the SCF—$CO_2$.

8. The process of claim 1, wherein the second temperature range comprises about 30° C. to about 80° C.

9. The process of claim 8, wherein the second temperature range comprises about 70° C. to about 75° C.

10. The process of claim 1, further comprising the step of venting the process.

11. The process of claim 10, wherein the predetermined time comprises a time after which substantially complete exhaustion of the colorant material from the SCF—$CO_2$ is attained.

12. The process of claim 10, wherein the venting of the process is carried out gradually in a series of steps.

13. The process of claim 1, further comprising the steps of:

(a) introducing the colorant material to the hydrophobic textile fiber at a temperature below a glass transition temperature of the fiber; and (b) heating the hydrophobic textile fiber and the colorant material in SCF—$CO_2$ under SCF pressure conditions to a temperature within the first temperature range according to a temperature profile whereby uptake of the colorant material into the hydrophobic textile fiber is initiated at a slower rate than would occur at the temperature within the first temperature range without use of the temperature profile.

14. The process of claim 10, wherein the venting of the process is carried out in a continuous controlled pressure reduction ramp comprising a rate of about 0.01 to about 1 lb/min.

15. The process of claim 13, wherein the temperature profile further comprises an increase in temperature at a rate ranging from about 1° C./minute to about 1.5° C./minute from a temperature range of about 40° C. to about 130° C.

16. The process of claim 1, wherein the hydrophobic textile fiber comprises polyester.

17. The process of claim 1, wherein the process is performed as a batch dyeing process.

18. A dyed textile material produced by the process of claim 1.

19. A process for dyeing a hydrophobic textile fiber with a colorant material in SCF—$CO_2$, the process comprising the steps of:

(a) selecting a colorant material according to a solubility profile for the colorant material in SCF—$CO_2$ wherein the selected colorant material is relatively more soluble in SCF—$CO_2$ at a first temperature range comprising about 60° C. to about 200° C. and relatively less soluble in SCF—$CO_2$ at a second temperature range comprising about 30° C. to about 80° C., the second temperature range further comprising a range in which the colorant material has a relatively greater affinity for the hydrophobic textile fiber than for the SCF—$CO_2$;

(b) heating the hydrophobic textile fiber and the colorant material in SCF—$CO_2$ under SCF pressure conditions to a temperature within the first temperature range to initiate dyeing; and (c) dyeing the hydrophobic textile fiber by cooling the process to a temperature within the second temperature range without venting the SCF—$CO_2$, whereby SCF—$CO_2$ density remains constant.

20. The process of claim 19, wherein the colorant material comprises press-cake solid particles which have no additives.

21. The process of claim 16, wherein the first temperature range comprises about 90° C. to about 140° C.

22. The process of claim 21, wherein the first temperature range comprises about 100° C. to about 130° C.

23. The process of claim 19, wherein the second temperature range further comprises a temperature range near the glass transition temperature of the hydrophobic textile fiber.

24. The process of claim 19, wherein the second temperature range comprises about 70° C. to about 75° C.

25. The process of claim 19, further comprising the step (c) of venting the process.

26. The process of claim 25, wherein the predetermined time comprises a time after which substantially complete exhausting of the colorant material from the SCF—$CO_2$ is attained.

27. The process of claim 25, wherein the venting of the process is carried out gradually in a series of steps.

28. The process of claim 19, further comprising the steps of:

(a) introducing the colorant material to the hydrophobic textile fiber at a temperature below a glass transition temperature of the fiber; and (b) heating the hydrophobic textile fiber and the colorant material in SCF—$CO_2$ under SCF pressure conditions to a temperature within the first temperature range according to a temperature profile whereby uptake of the colorant material into the hydrophobic textile fiber is initiated at a slower rate than would occur at the temperature within the first temperature range without use of the temperature profile.

29. The process of claim 25, wherein the venting of the process is carried out in a continuous controlled pressure reduction ramp comprising a rate of about 0.01 to about 1 lb/min.

30. The process of claim 28, wherein the temperature profile further comprises an increase in temperature at a rate ranging from about 1° C./minute to about 1.5° C./minute from a temperature of about 40° C. to about 130° C.

31. The process of claim 19, wherein the hydrophobic textile fiber comprises polyester.

32. The process of claim 19, wherein the process is performed as a batch dyeing process.

33. A dyed textile material produced by the process of claim 19.

34. A process for dyeing a hydrophobic textile fiber with a colorant material in SCF—$CO_2$, the process comprising the steps of:

(a) selecting a colorant material according to a solubility path for the colorant material in SCF—$CO_2$ wherein the selected colorant material is relatively more soluble in SCF—$CO_2$ at a first density range and relatively less soluble in SCF—$CO_2$ or near-critical fluid $CO_2$ at a second density range, the second density range comprising a lower density range than the first density range;

(b) adjusting the density of the SCF—$CO_2$ under SCF pressure conditions to a density within the first density range by adding $CO_2$ to initiate dyeing of the hydrophobic textile fiber with the colorant material;

(c) heating the hydrophobic textile fiber and the colorant material in SCF—$CO_2$ under SCF pressure conditions to a dyeing temperature, wherein the dyeing temperature is established according to the solubility path of the colorant material in SCF—$CO_2$; and (d) dyeing the hydrophobic textile fiber by reducing the density of the SCF—$CO_2$ to a density within the second density range by venting $CO_2$ from the process without reducing the temperature of the process.

35. The process of claim 34, wherein the colorant material comprises press-cake solid particles which have no additives.

36. The process of claim 34, wherein the first density range comprises about 0.4 g/cm$^3$ to about 0.7 g/cm$^3$.

37. The process of claim 36, wherein the density within the first density range comprises about 0.62 g/cm$^3$.

38. The process of claim 34, wherein the second density range comprises a range in which the colorant material has a relatively greater affinity for the hydrophobic textile fiber than for the SCF—$CO_2$.

39. The process of claim 34, wherein the second density range comprises about 0.3 g/cm$^3$ to about 0.5 g/cm$^3$.

40. The process of claim 39, wherein the density within the second density range comprises about 0.45 g/cm$^3$.

41. The process of claim 34, wherein the venting of $CO_2$ is carried out gradually in a series of steps.

42. The process of claim 34, wherein the venting of the process is carried out in a continuous controlled pressure reduction ramp comprising a rate of about 0.01 to about 1 lb/min.

43. The process of claim 34, further comprising the steps of:

(a) introducing the colorant material to the hydrophobic textile fiber at a temperature below a glass transition temperature of the fiber; and (b) heating the hydrophobic textile fiber and the colorant material in SCF—$CO_2$ under SCF pressure conditions to the dyeing temperature according to a temperature profile whereby uptake of colorant material into the hydrophobic textile fiber is initiated at a slower rate than would occur at the dyeing temperature without use of the temperature profile.

44. The process of claim 43, wherein the temperature profile further comprises an increase in temperature at a rate ranging from about 1° C./minute to about 1.5° C./minute from a tempeture of about 40° C. to about 130° C.

45. The process of claim 34, wherein the hydrophobic textile fiber comprises polyester.

46. The process of claim 34, wherein the process is performed as a batch dyeing process.

47. A dyed textile material produced by the process of claim 34.

48. A process for dyeing a hydrophobic textile fiber with a colorant material in SCF—$CO_2$, the process comprising the steps of:

(a) selecting a colorant material according to a solubility path for the colorant material in SCF—$CO_2$ wherein the selected colorant material is relatively more soluble in SCF—$CO_2$ at a first density range and relatively less soluble in SCF—$CO_2$ or near-critical fluid $CO_2$ at a second density range, the second density range comprising a lower density range than the first density range;

(b) adjusting the density of the SCF—$CO_2$ under SCF pressure conditions to a density within the first density range by adding $CO_2$ to initiate dyeing of the hydrophobic textile fiber with the colorant material;

(c) heating the hydrophobic textile fiber and the colorant material in SCF—$CO_2$ under SCF pressure conditions to a dyeing temperature, wherein the dyeing temperature is established according to the solubility path of the colorant material in SCF—$CO_2$;

(d) dyeing the hydrophobic textile fiber by reducing the density of the SCF—$CO_2$ to a density within the second density range by venting $CO_2$ from the process while simultaneously lowering the dyeing temperature to a second temperature according to the solubility path for the colorant material in SCF—$CO_2$ wherein the colorant material is relatively less soluble in SCF—$CO_2$ as compared to the dyeing temperature.

49. The process of claim 48, wherein the density within the second range comprises about 0.3 g/cm$^3$ to about 0.5 g/cm$^3$.

* * * * *